US009442465B2

(12) United States Patent
Yamamoto et al.

(10) Patent No.: US 9,442,465 B2
(45) Date of Patent: Sep. 13, 2016

(54) ELECTRONIC TIMEPIECE AND CONTROL METHOD OF ELECTRONIC TIMEPIECE

(71) Applicant: SEIKO INSTRUMENTS INC., Chiba-shi, Chiba (JP)

(72) Inventors: Kosuke Yamamoto, Chiba (JP); Kenji Ogasawara, Chiba (JP); Kazuhiro Koyama, Chiba (JP); Kazumi Sakumoto, Chiba (JP); Tamotsu Maesawa, Chiba (JP); Tomohiro Ihashi, Chiba (JP); Ayumi Matsumoto, Chiba (JP); Akira Takakura, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/938,968

(22) Filed: Nov. 12, 2015

(65) Prior Publication Data

US 2016/0139569 A1 May 19, 2016

(30) Foreign Application Priority Data

Nov. 13, 2014 (JP) ..... 2014-230859
Aug. 21, 2015 (JP) ..... 2015-163995

(51) Int. Cl.

| | |
|---|---|
| ***G04C 10/02*** | (2006.01) |
| ***G04G 19/00*** | (2006.01) |
| ***G04G 19/06*** | (2006.01) |
| ***G04G 17/02*** | (2006.01) |
| ***G04G 3/00*** | (2006.01) |

(52) U.S. Cl.

CPC ..... *G04G 19/06* (2013.01); *G04C 10/02* (2013.01); *G04G 3/00* (2013.01); *G04G 17/02* (2013.01); *G04G 19/00* (2013.01)

(58) Field of Classification Search

CPC ..... G04C 10/02; G04G 3/00; G04G 17/02; G04G 19/00; G04G 19/02; G04G 19/06

See application file for complete search history.

(56) References Cited

U.S. PATENT DOCUMENTS

| | | | | |
|---|---|---|---|---|
| 4,760,564 | A * | 7/1988 | Odagiri | G04C 10/02 368/204 |
| 5,016,231 | A | 5/1991 | Kawaguchi et al. | 368/80 |
| 2008/0253236 | A1 | 10/2008 | Nakamiya | 368/204 |
| 2010/0165797 | A1* | 7/2010 | Asami | G04G 19/10 368/204 |
| 2012/0044787 | A1* | 2/2012 | Manaka | G04C 3/143 368/80 |
| 2013/0142018 | A1* | 6/2013 | Koike | G04C 10/04 368/205 |

* cited by examiner

*Primary Examiner* — Vit W Miska
(74) *Attorney, Agent, or Firm* — Adams & Wilks

(57) ABSTRACT

An electronic timepiece includes a solar power source, a voltage stabilizer circuit that generates a constant voltage by using power supplied from the solar power source, and a control circuit that clocks the time by driving a rotating body at first hand operation speed and at second hand operation speed which is faster than the first hand operation speed. The control circuit selects a voltage of the solar power source so as to drive the rotating body in a case of the first hand operation speed, and selects at least any one voltage of the constant voltage and the voltage of the solar power source so as to drive the rotating body in a case of the second hand operation speed.

10 Claims, 10 Drawing Sheets

101 OSCILLATOR CIRCUIT
102 FREQUENCY DIVIDER CIRCUIT
103 CONTROL CIRCUIT
106 POWER SOURCE VOLTAGE DETECTION CIRCUIT
105 SECONDARY BATTERY
104 SOLAR PANEL
107 VOLTAGE STABILIZER CIRCUIT
108 FAST-FORWARDING PULSE GENERATION UNIT
111 MOTOR
109 NORMAL FORWARDING PULSE GENERATION UNIT
110 AUXILIARY DRIVE PULSE GENERATION UNIT
112 ROTATION DETECTION/DETERMINATION CIRCUIT
113 INPUT UNIT

101 OSCILLATOR CIRCUIT
102 FREQUENCY DIVIDER CIRCUIT
103 CONTROL CIRCUIT
106 POWER SOURCE VOLTAGE DETECTION CIRCUIT
105 SECONDARY BATTERY
104 SOLAR PANEL
107 VOLTAGE STABILIZER CIRCUIT

108 FAST-FORWARDING PULSE GENERATION UNIT
111 MOTOR
109 NORMAL FORWARDING PULSE GENERATION UNIT
110 AUXILIARY DRIVE PULSE GENERATION UNIT
112 ROTATION DETECTION/DETERMINATION CIRCUIT
113 INPUT UNIT

| MOTOR | NORMAL FORWARDING OPERATION | FAST-FORWARDING OPERATION |
|---|---|---|
| DRIVING METHOD | DRIVING BY USING BATTERY VOLTAGE | DRIVING BY USING CONSTANT VOLTAGE |
| AVERAGE VOLTAGE VALUE [V] | 2.6 | 2.3 |
| CURRENT CONSUMPTION [μA] | 0.38 | 0.43 |
| THRESHOLD DRIVE FREQUENCY [Hz] | - | 256 |

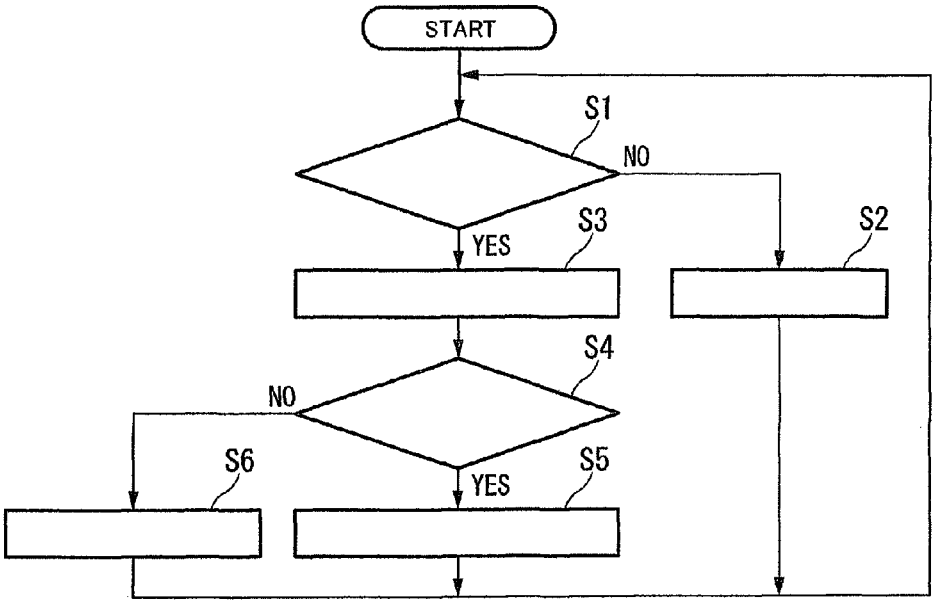

S1 FAST-FORWARDING OPERATION?
S3 DETECT VOLTAGE VALUE OF SECONDARY BATTERY
S2 DRIVE BY USING BATTERY VOLTAGE
S4 VOLTAGE VALUE > 2.3 V?
S6 PERFORM FAST-FORWARDING OPERATION BY USING BATTERY VOLTAGE
S5 PERFORM FAST-FORWARDING OPERATION BY USING CONSTANT VOLTAGE

FIG.6

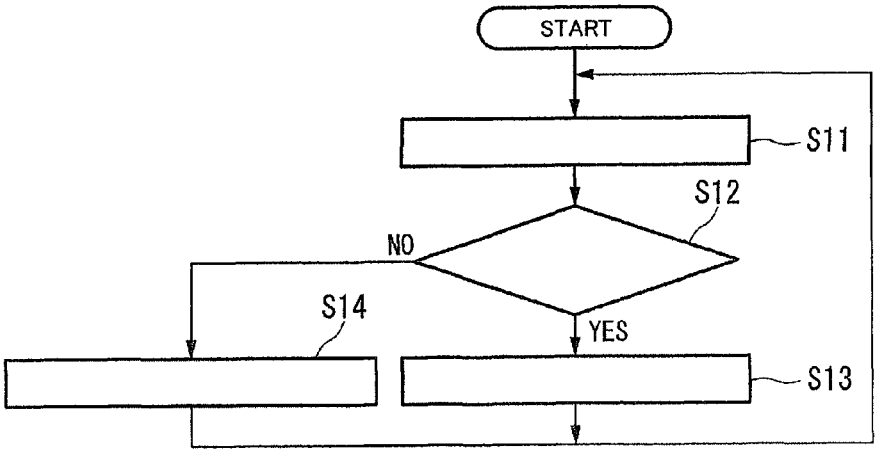

S11 DETECT VOLTAGE VALUE OF SECONDARY BATTERY
S12 VOLTAGE VALUE > 2.3 V?
S14 PERFORM NORMAL FORWARDING OPERATION OR FAST-FORWARDING OPERATION BY USING BATTERY VOLTAGE
S13 PERFORM NORMAL FORWARDING OPERATION OR FAST-FORWARDING OPERATION BY USING CONSTANT VOLTAGE

FIG.7

| | |
|---|---|
| FIRST THRESHOLD VALUE | $V_{ref1}$ |
| SECOND THRESHOLD VALUE | $V_{ref2}$ |

FIG.9

| BATTERY VOLTAGE VALUE (BVV) | VOLTAGE USED IN NORMAL FORWARDING OPERATION FOR SECOND HAND | VOLTAGE USED IN NORMAL FORWARDING OPERATION FOR MINUTE HAND AND HOUR HAND, AND USED IN FAST-FORWARDING OPERATION |
|---|---|---|
| $BVV > V_{ref1}$ | BATTERY VOLTAGE | CONSTANT VOLTAGE |
| $V_{ref1} \geq BVV \geq V_{ref2}$ | BATTERY VOLTAGE | BATTERY VOLTAGE |
| $V_{ref2} > BVV$ | BATTERY VOLTAGE (LOW VOLTAGE OPERATION MODE) | - (OPERATION STOP) |

FIG.10

| | FORWARD ROTATION | REVERSE ROTATION |
|---|---|---|
| VOLTAGE VALUE OF CONSTANT VOLTAGE | Vc (FORWARD) | Vc (REVERSE) |
| FIRST THRESHOLD VALUE | $V_{ref1}$ (FORWARD) | $V_{ref1}$ (REVERSE) |
| SECOND THRESHOLD VALUE | $V_{ref2}$ (FORWARD) | $V_{ref2}$ (REVERSE) |

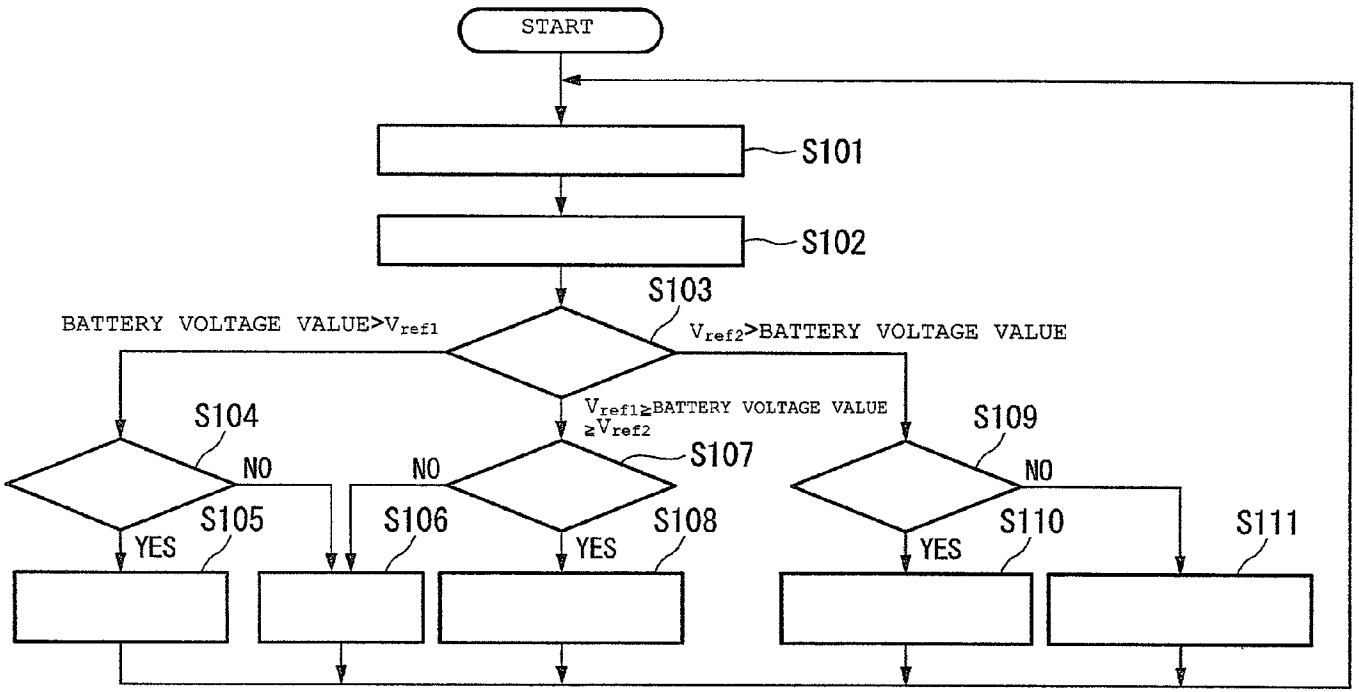

S101 DETECT VOLTAGE VALUE OF SECONDARY BATTERY
S102 COMPARE VOLTAGE VALUE WITH THRESHOLD VALUE
S103 VOLTAGE VALUE
S104 FAST-FORWARDING OPERATION?
S107 FAST-FORWARDING OPERATION?
S109 FAST-FORWARDING OPERATION?

S105 DRIVE FAST-FORWARDING OPERATION BY USING CONSTANT VOLTAGE
S106 DRIVE NORMAL FORWARDING OPERATION BY USING BATTERY VOLTAGE
S108 DRIVE FAST-FORWARDING OPERATION BY USING BATTERY VOLTAGE
S110 STOP DRIVING FAST-FORWARDING OPERATION
S111 DRIVE NORMAL FORWARDING OPERATION BY USING BATTERY VOLTAGE (LOW VOLTAGE OPERATION)

FIG.13

| TIME [sec] | VOLTAGE VALUE [V] | FAST-FORWARDING PULSE WIDTH [msec] |
|---|---|---|
| t0 | 2.3 | 3.90 |
| t1 | 2.25 | 3.99 |
| t2 | 2.2 | 4.08 |
| t3 | 2.15 | 4.18 |
| ... | ... | ... |

FIG.15

ELECTRONIC TIMEPIECE AND CONTROL METHOD OF ELECTRONIC TIMEPIECE

BACKGROUND OF THE INVENTION

1. Field of the Invention

The present invention relates to an electronic timepiece and a control method of an electronic timepiece.

2. Background Art

An analog electronic timepiece is known which displays the time on a dial by using an indicating hand. Some analog electronic timepieces have a timer function or as stopwatch function. In these electronic timepieces, a fast-forwarding operation of the indicating hand is performed, when the time is corrected, or when the indicating hand is returned to an initial position in order to use the timer function or the stopwatch function. In the analog timepieces, the indicating hand is driven in a normal direction and in a reverse direction thereof by a stepping motor. The normal direction represents a clockwise rotating direction. The indicating hand includes an hour hand which rotates once in 12 hours, a minute hand which rotates once in 60 minutes, a second hand which rotates once in one minute, and a functional hand used for the timer function or the stopwatch function. The stepping motor performs a rotary operation using a drive pulse having a pulse width corresponding to a predetermined drive voltage and a predetermined drive frequency, and drives each indicating hand via a train wheel mechanism.

For example, in an analog electronic timepiece disclosed in JP-A-2-138895, a voltage stabilizer circuit generates a low constant voltage of approximately 1.2 V from a battery voltage (approximately 1.58 V). Then, the analog electronic timepiece disclosed in JP-A-2-138895 uses the generated low constant voltage so as to perform driving for forwarding the indicating hand at normal speed on a time display and driving for forwarding a position of the functional hand at fast speed in the stopwatch function. In a case of the time display, driving the hour hand, the minute hand, and the second hand at normal speed is referred to as a normal hand operation, and driving the indicating hand at fast-forwarding speed is referred to as a fast-forwarding hand operation.

In recent years, an analog electronic timepiece is known in which light energy is converted into electrical energy by using a solar cell and the converted electrical energy is stored in a secondary battery so as to be used for power to drive the indicating hand. For example, a voltage value of the secondary battery is 2.0 V to 2.6 V. Therefore, this analog electronic timepiece uses a voltage of the secondary battery by causing a regulator to convert the voltage into a constant voltage of 2.2 V, for example.

For example, in an analog electronic timepiece disclosed in JP-A-2012-145594, a voltage value of a secondary battery which stores electrical energy generated by a generating device is detected. Then, when the detected voltage value is equal to or greater than a predetermined value, a control logic circuit performs discharge control by performing control for causing a discharge current to flow to a drive circuit. In this manner, the analog electronic timepiece disclosed in JP-A-2012-145594 utilizes a constant voltage which is rapidly lowered from a voltage to be supplied to a motor. The reason for the discharge is to prevent a step-out phenomenon. The step-out phenomenon means a phenomenon in which a stepping motor cannot be stopped at a predetermined position since energy of an input pulse deviates from a target.

SUMMARY OF THE INVENTION

However, according to a technique disclosed in JP-A-2-138895 and JP-A-2012-145594, a drive voltage used in a normal hand operation and a fast-forwarding hand operation is a constant voltage. Consequently, current consumption of an analog electronic timepiece can only be reduced down to a value which is based on the constant voltage.

The present invention is made in view of the above-described problem, and an object thereof is to provide an electronic timepiece and a control method of an electronic timepiece in which current consumption can be reduced in an analog electronic timepiece which clocks the time using a normal hand operation and a fast-forwarding hand operation.

In order to achieve the above-described object, according to an aspect of the present invention, there is provided an electronic timepiece including a solar power source, a voltage stabilizer circuit that generates a constant voltage by using power supplied from the solar power source, and a control circuit that clocks the time by driving a rotating body at first hand operation speed and at second hand operation speed which is faster than the first hand operation speed. The control circuit selects a voltage of the solar power source so as to drive the rotating body in a case of the first hand operation speed, and selects at least any one voltage of the constant voltage and the voltage of the solar power source so as to drive the rotating body in a case of the second hand operation speed.

In the electronic timepiece according to the aspect of the present invention, the rotating body may include an hour hand, a minute hand, and a second hand. The electronic timepiece may further include multiple motors which respectively drive the hour hand, the minute hand, and the second hand. In a case of the first hand operation speed, the control circuit may drive at least the second hand within the rotating body by using the voltage of the solar power source.

In the electronic timepiece according to the aspect of the present invention, the control circuit may have two threshold values of a first threshold value for determining a voltage value of the solar power source and a second threshold value which is smaller than the first threshold value. The control circuit may compare the voltage value of the solar power source with the two threshold values, and may switch a voltage used in the case of the second hand operation speed in accordance with a comparison result.

The electronic timepiece according to the aspect of the present invention may further include a detection unit that detects the voltage value of the solar power source. When the detected voltage value of the solar power source is greater than the first threshold value, the control circuit may drive the rotating body at the first hand operation speed by using the voltage of the solar power source, and may drive the rotating body at the second hand operation speed by using the constant voltage. When the detected voltage value of the solar power source is equal to or smaller than the first threshold value and equal to or greater than the second threshold value, the control circuit may drive the rotating body at the first hand operation speed and at the second hand operation speed by using the voltage of the solar power source. When the detected voltage value of the solar power source is smaller than the second threshold value, the control circuit may drive the rotating body at the first hand operation speed by using a voltage whose voltage value is smaller than the voltage value of the solar power source, and may switch the voltage so as to stop driving the rotating body at the second hand operation speed.

The electronic timepiece according to the aspect of the present invention may further include an input unit that receives an instruction. The detection unit may detect the voltage value of the solar power source, when the instruction received by the input unit is given so as to drive the rotating body at the second hand operation speed.

In the electronic timepiece according to the aspect of the present invention, when the rotating body is driven at the second hand operation speed, a drive pulse width may be widened as the rotating body is progressively driven at the second hand operation speed.

In the electronic timepiece according to the aspect of the present invention, the rotating body which is driven at the second hand operation speed may perform a forward rotation operation and a reverse rotation operation. The control circuit may perform at least any one between selecting and changing each value of the first threshold value and the second threshold value in accordance with the forward rotation operation or the reverse rotation operation.

In order to achieve the above-described object, according to another aspect of the present invention, there is provided a control method of an electronic timepiece that has two threshold values of a first threshold value for determining a voltage value of a solar power source and a second threshold value which is smaller than the first threshold value, and that clocks the time by driving a rotating body at first hand operation speed and at second hand operation speed which is faster than the first hand operation speed. The control method includes a voltage stabilizing procedure in which a voltage stabilizer circuit generates a constant voltage by using power supplied from the solar power source, a procedure in which a control circuit drives the rotating body by using a voltage of the solar power source in a case of the first hand operation speed, a procedure in which when the voltage value of the solar power source is greater than the first threshold value, the control circuit drives the rotating body at the first hand operation speed by using the voltage of the solar power source, and drives the rotating body at the second hand operation speed by using the constant voltage, a procedure in which when the voltage value of the solar power source is equal to or smaller than the first threshold value and equal to or greater than the second threshold value, the control circuit drives the rotating body at the first hand operation speed and at the second hand operation speed by using the voltage of the solar power source, and a procedure in which when the voltage value of the solar power source is smaller than the second threshold value, the control circuit drives the rotating body at the first hand operation speed by using a voltage whose voltage value is smaller than the voltage value of the solar power source, and switches the voltage so as to stop driving the rotating body at the second hand operation speed.

According to the aspects of the present invention, current consumption can be reduced in an analog electronic timepiece which clocks the time by performing a normal hand operation and a fast-forwarding hand operation.

BRIEF DESCRIPTION OF THE DRAWINGS

FIG. 6 is a flowchart of process procedures in the normal forwarding and the fast-forwarding of the electronic timepiece according to the first embodiment.

FIG. 7 is a flowchart of process procedures in normal forwarding and fast-forwarding of an electronic timepiece in the related art.

FIG. 9 is a table illustrating an example of a first threshold value and a second threshold value which are stored in a storage unit according to the second embodiment.

FIG. 10 is a table illustrating a relationship among a battery voltage, a threshold value, a voltage used in normal forwarding, and a voltage used in fast-forwarding, which are stored in the storage unit according to the second embodiment.

FIG. 13 is a flowchart of process procedures in the normal forwarding and the fast-forwarding of the electronic timepiece according to the second embodiment.

FIG. 15 is a table illustrating an example of information which is stored in a storage unit according to a modification example of the second embodiment.

DETAILED DESCRIPTION OF THE INVENTION

First Embodiment

Figure 1:
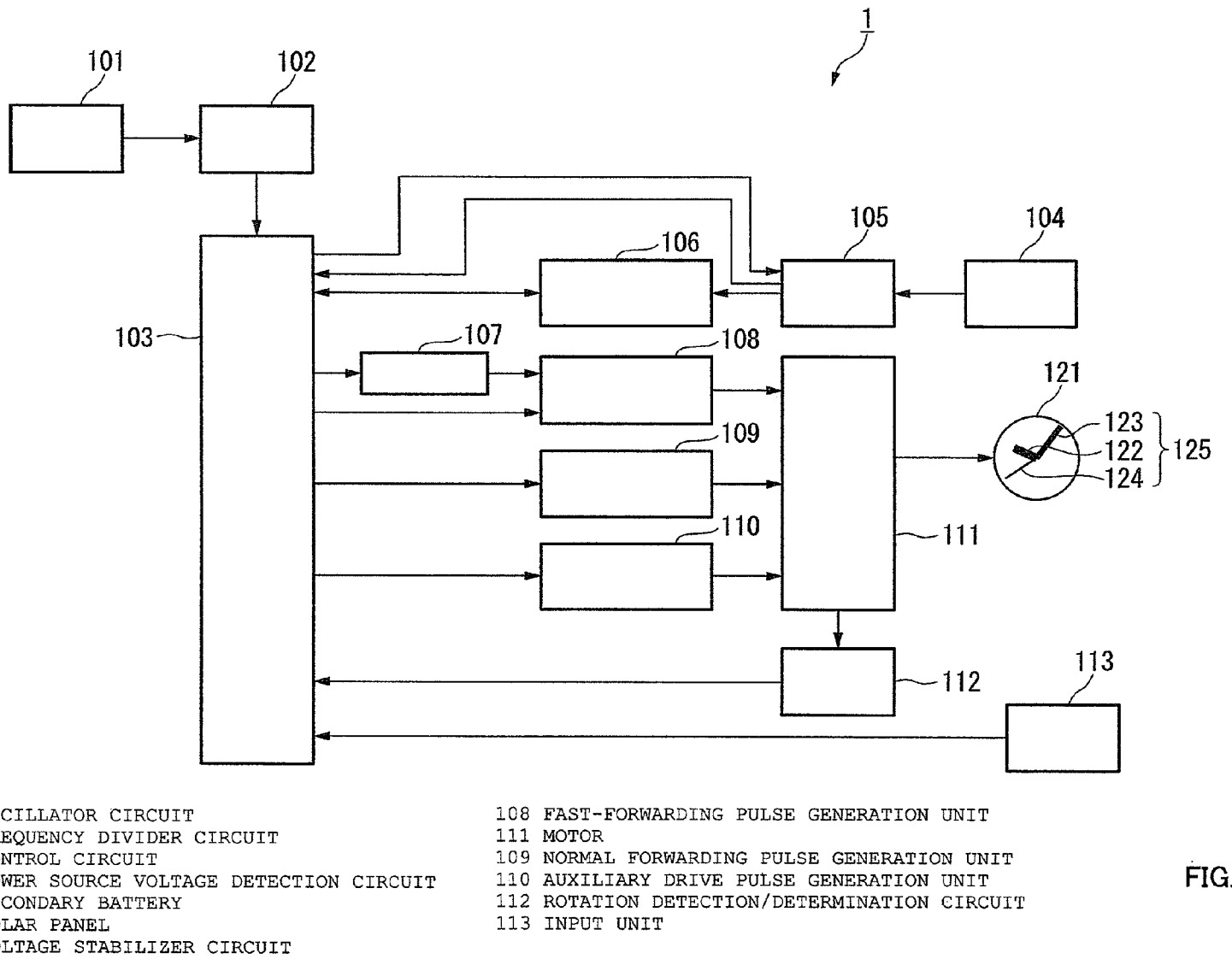
FIG. 1 is a block diagram illustrating a configuration of an electronic timepiece according to a first embodiment.
Figure 2:
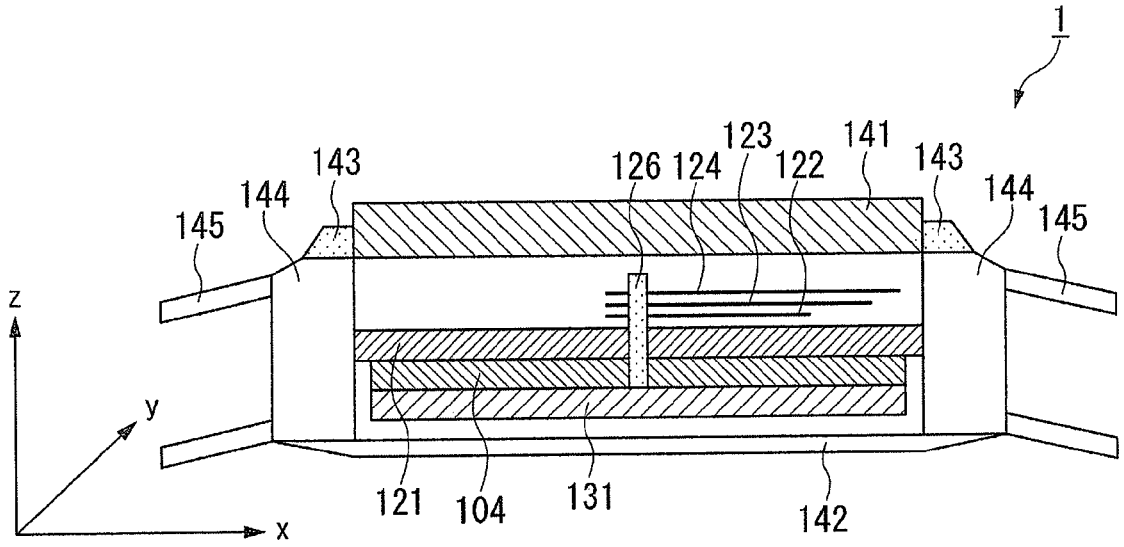
FIG. 2 is a schematic sectional view of the electronic timepiece according to the first embodiment.

FIG. 1 is a block diagram illustrating a configuration of an electronic timepiece 1 according to the present embodiment. FIG. 2 is a schematic sectional view of the electronic timepiece 1 according to the present embodiment.

The electronic timepiece 1 according to the present embodiment is an analog electronic timepiece which displays the time by using an indicating hand in an analog method.

As illustrated in FIG. 1, the electronic timepiece 1 is configured to include an oscillator circuit 101, a frequency divider circuit 102, a control circuit 103, a solar panel 104, a secondary battery 105, a power source voltage detection circuit 106, a voltage stabilizer circuit 107, a fast-forwarding pulse generation unit 108, a normal forwarding pulse generation unit 109, an auxiliary drive pulse generation unit 110, a motor 111, a rotation detection/determination circuit 112, an input unit 113, a dial 121, an hour hand 122, a minute hand 123, and a second hand 124. Hereinafter, any unspecified one among the hour hand 122, the minute hand 123, and the second hand 124 is referred to as an indicating hand 125.

First, an arrangement of each component inside the electronic timepiece 1 will be described with reference to FIG. 2.

As illustrated in FIG. 2, the electronic timepiece 1 is configured to include the solar panel 104, the dial 121, the hour hand 122, the minute hand 123, the second hand 124, an indicating hand axle 126, a circuit board 131, a windshield 141, a rear cover 142, a bezel 143, a case 144, and a belt 145. In FIG. 2, a direction parallel to an edge of the belt 145 of the electronic timepiece 1 is referred to as an x-axis direction, a direction perpendicular to the x-axis is referred to as a y-axis direction, and a thickness direction of the electronic timepiece 1 is referred to as a z-axis direction.

The circuit board 131, the solar panel 104, the dial 121, the indicating hand axle 126, the hour hand 122, the minute hand 123, and the second hand 124 are incorporated into the case 144, sequentially from below in the z-axis direction. The case 144 is formed in a substantially cylindrical shape, for example. The windshield 141 is attached to an opening on a front surface side via the bezel 143. Furthermore, the belt 145 is attached to the case 144. For example, a material of the case 144 includes a resin, rubber, metal (titanium or the like), ceramic, and the like.

The windshield 141 is attached to the case by using the bezel 143 in order to protect the dial 121 or internal components of the electronic timepiece 1. The windshield 141 is formed of a material which transmits sunlight or illumination light required for charging. For example, a material of the windshield 141 includes inorganic glass, sapphire glass, plastic, and the like.

The dial 121 is formed of a material which transmits sunlight or illumination light required for charging the solar panel 104. For example, the dial 121 may have multiple small apertures formed therein so as to transmit sunlight or illumination light required for charging.

The solar panel 104 is arranged between the dial 121 and the circuit board 131. If the solar panel 104 is translucent, the solar panel 104 may be arranged between the dial 121 and the windshield 141.

The indicating hand axle 126 has each axle of the hour hand 122, the minute hand 123, and the second hand 124. The hour hand 122, the minute hand 123, and the second hand 124 are fitted to each axle of the indicating hand axle 126.

In an example illustrated in FIGS. 1 and 2, the hour hand 122, the minute hand 123, and the second hand 124 are illustrated as a rotating body which is driven by the motor 111. However, the rotating body may be a disk on which characters such as numerals and days are marked.

The oscillator circuit 101, the frequency divider circuit 102, the control circuit 103, the power source voltage detection circuit 106, the voltage stabilizer circuit 107, the fast-forwarding pulse generation unit 108, the normal forwarding pulse generation unit 109, the auxiliary drive pulse generation unit 110, the motor 111, and the rotation detection/determination circuit 112 which are illustrated in FIG. 1 are attached to the circuit board 131. The solar panel 104, the secondary battery 105 (refer to FIG. 1), and the input unit 113 (refer to FIG. 1) are connected to the circuit board 131.

The rear cover 142 protects a rear surface of the electronic timepiece 1. As an example, a material of the rear cover 142 is a resin or metal.

The bezel 143 is a component attached to the periphery of the windshield 141. The bezel 143 has a function of protecting the windshield 141, a function of ensuring waterproofness, or a marking function of complementing a display function of the electronic timepiece 1.

The belt 145 is used in order for a user to wear the electronic timepiece 1 on his or her wrist (arm).

Referring back to FIG. 1, each functional unit of the electronic timepiece 1 will be described.

The input unit 113 receives an input operated by a user, and outputs information indicating the received operation content to the control circuit 103. The input unit 113 is a crown or a button. The input unit 113 may have a communication device which receives information from a mobile terminal (not illustrated).

The oscillator circuit 101 includes a crystal oscillator, and generates an oscillation clock signal having a predetermined frequency (for example, 32 kHz) based on the oscillation of the crystal oscillator. The oscillator circuit 101 outputs the generated oscillation signal to the frequency divider circuit 102.

The frequency divider circuit 102 divides the oscillation signal input from the oscillator circuit 101, and generates a normal signal used during a normal hand operation and a fast-forwarding signal used during a fast-forwarding hand operation. A drive frequency of the normal signal used during the normal hand operation is 1 Hz, for example. Here, on a time display, driving the hour hand, the minute hand, and the second hand is referred to as the normal hand operation (driving at first hand operation speed), and driving the indicating hand through fast-forwarding is referred to as the fast-forwarding hand operation (driving at second hand operation speed). A threshold drive frequency of the fast-forwarding signal is 256 Hz, for example. The threshold drive frequency represents the maximum drive frequency in which a step-out phenomenon does not occur in the motor 111. The drive frequency represents a frequency of a pulse signal for driving the motor 111. The frequency divider circuit 102 outputs the generated normal signal and the generated fast-forwarding signal to the control circuit 103.

A battery voltage is supplied to the control circuit 103 from the secondary battery 105. Information indicating operation content is input to the control circuit 103 from the input unit 113. When the information indicating the input operation content is information indicating a fast-forwarding instruction, the control circuit 103 outputs an instruction to detect a voltage value of the secondary battery 105 to the power source voltage detection circuit 106. Information indicating the voltage value is input to the control circuit 103 from the power source voltage detection circuit 106 in accordance with the instruction to detect the voltage value. The control circuit 103 supplies the supplied battery voltage to the voltage stabilizer circuit 107, the normal forwarding pulse generation unit 109, and the auxiliary drive pulse generation unit 110. When the information indicating the voltage value is equal to or smaller than a predetermined voltage value, the control circuit 103 switches the destination of the supplied battery voltage from the voltage stabilizer circuit 107 to the fast-forwarding pulse generation unit 108. The predetermined voltage value is 2.3 V, for example.

When information indicating fast-forwarding is input from the input unit 113, the control circuit 103 outputs an instruction to generate a fast-forwarding pulse (hereinafter, referred to as a fast-forwarding instruction) to the fast-forwarding pulse generation unit 108. When the information indicating fast-forwarding is not input from the input unit 113, the control circuit 103 outputs an instruction to generate a normal pulse (hereinafter, referred to as a normal forwarding instruction) to the normal forwarding pulse generation unit 109. When based on the information input from the rotation detection/determination circuit 112, the control circuit 103 determines that it is necessary to correct a normal forwarding pulse signal, the control circuit 103 adjusts a pulse width so as to correct the pulse signal, or outputs an instruction to generate an auxiliary drive pulse signal for adjusting the number of pulse signals, to the auxiliary drive pulse generation unit 110.

The control circuit 103 performs control for charging the secondary battery 105 with electrical energy generated by the solar panel 104. The control circuit 103 performs overcharging prevention control for the secondary battery 105.

Furthermore, based on a pattern of an induced signal input from the rotation detection/determination circuit 112, the control circuit 103 determines a rotation state of the motor 111. When based on the determination result, it is necessary to perform correction driving, the control circuit 103 outputs information indicating a correction instruction (hereinafter, referred to as an auxiliary drive instruction) to the auxiliary drive pulse generation unit 110.

The solar panel 104 is operated as a power generation unit which receives light (sun, illumination, or the like) and convert the light into electrical energy. The solar panel 104 supplies the converted electrical energy to the secondary battery 105.

The secondary battery 105 is charged with the electrical energy supplied from the solar panel 104 by the control of the control circuit 103. The secondary battery 105 supplies power to the control circuit 103.

In accordance with the instruction to detect the voltage value which is input from the control circuit 103, the power source voltage detection circuit 106 detects a voltage value of the secondary battery 105, and outputs information indicating the detected voltage value to the control circuit 103.

The voltage stabilizer circuit 107 converts the voltage supplied from the control circuit 103 into a predetermined constant voltage which does not depend on fluctuations in a power source voltage, and supplies the converted constant voltage to the fast-forwarding pulse generation unit 108. The predetermined constant voltage represents 2.3 V, for example.

When the fast-forwarding instruction is input from the control circuit 103, the fast-forwarding pulse generation unit 108 generates a fast-forwarding pulse signal by using the battery voltage supplied from the control circuit 103 or the constant voltage supplied from the voltage stabilizer circuit 107, in accordance with the fast-forwarding instruction input from the control circuit 103. Here, the fast-forwarding pulse signal is configured so that when the voltage value of the secondary battery 105 is greater than 2.3 V, a drive voltage value thereof is 2.3 V of the constant voltage and a drive frequency thereof is 128 Hz, for example. The fast-forwarding pulse signal is configured so that when the voltage value of the secondary battery 105 is equal to or smaller than 2.3 V, the drive voltage value is the voltage value of the secondary battery 105 (however, equal to or smaller than 2.3 V) and the drive frequency is 128 Hz, for example. The fast-forwarding pulse generation unit 108 outputs the generated fast-forwarding pulse signal to the motor 111.

The reason why the voltage of the secondary battery 105 is not directly used for the fast-forwarding operation is that a step-out phenomenon sometimes occurs in the motor 111 since energy supplied to the motor 111 is extremely great if the indicating hand 125 is driven by using the drive voltage of 2.8 V and the drive frequency of 128 Hz.

When the normal forwarding instruction is input from the control circuit 103, the normal forwarding pulse generation unit 109 generates a normal forwarding pulse signal by using the battery voltage supplied from the control circuit 103, in accordance with the normal forwarding instruction input from the control circuit 103. Here, the normal forwarding pulse signal is configured so that when the voltage value of the secondary battery 105 is greater than 2.3 V, the drive voltage value is the voltage value of the secondary battery 105 (for example, 2.6 V to 2.3 V) and the drive frequency is 1 Hz. The normal forwarding pulse generation unit 109 outputs the generated normal forwarding pulse signal to the motor 111.

When the normal forwarding operation is driven by using the voltage of the secondary battery 105 having the voltage value which is greater than 2.3 V of the constant voltage, since the drive frequency is 1 Hz, a sufficient time for stopping a rotor 202 (refer to FIG. 3) can be obtained. Accordingly, a step-out phenomenon hardly occurs in the motor 111. Therefore, even if the normal forwarding operation is performed by using the voltage of the secondary battery 105, the electronic timepiece 1 can stably operate the indicating hand.

When the auxiliary drive instruction is input from the control circuit 103, the auxiliary drive pulse generation unit 110 generates an auxiliary drive pulse signal by using the battery voltage supplied from the control circuit 103, in accordance with the auxiliary drive instruction input from the control circuit 103. The auxiliary drive pulse generation unit 110 outputs the generated auxiliary drive pulse signal to the motor 111.

The motor 111 is a stepping motor. When the fast-forwarding pulse signal is input from the fast-forwarding pulse generation unit 108, the motor 111 drives the indicating hand 125 in accordance with the input fast-forwarding pulse signal. Alternatively, when the normal forwarding pulse signal is input from the normal forwarding pulse generation unit 109, the motor 111 drives the indicating hand 125 in accordance with the input normal forwarding pulse signal. Alternatively, when the auxiliary drive pulse signal is input from the auxiliary drive pulse generation unit 110, the motor 111 drives the indicating hand 125 in accordance with the input auxiliary drive pulse signal.

The rotation detection/determination circuit 112 detects an induced signal generated by free vibrations while the motor 111 is rotatably driven, and outputs a pattern of the induced signal which represents a rotation state of the motor 111 (driving state representing whether or not the motor 111 is rotated), to the control circuit 103. For example, the rotation detection/determination circuit 112 detects the rotation state of the motor 111 by using a technique disclosed in JP-A-2008-154336.

The hour hand 122 rotates once in 12 hours, the minute hand 123 rotates once in 60 minutes, and the second hand 124 rotates once in one minute.

In the present embodiment, an example has been described in which power is supplied to the control circuit 103 from the secondary battery 105. However, the present embodiment is not limited thereto. The power of the secondary battery 105 may be supplied to the voltage stabilizer circuit 107, and the voltage stabilizer circuit 107 may supply a constant voltage to the control circuit 103.

Next, a configuration and an operation of the motor 111 will be described.

Figure 3:
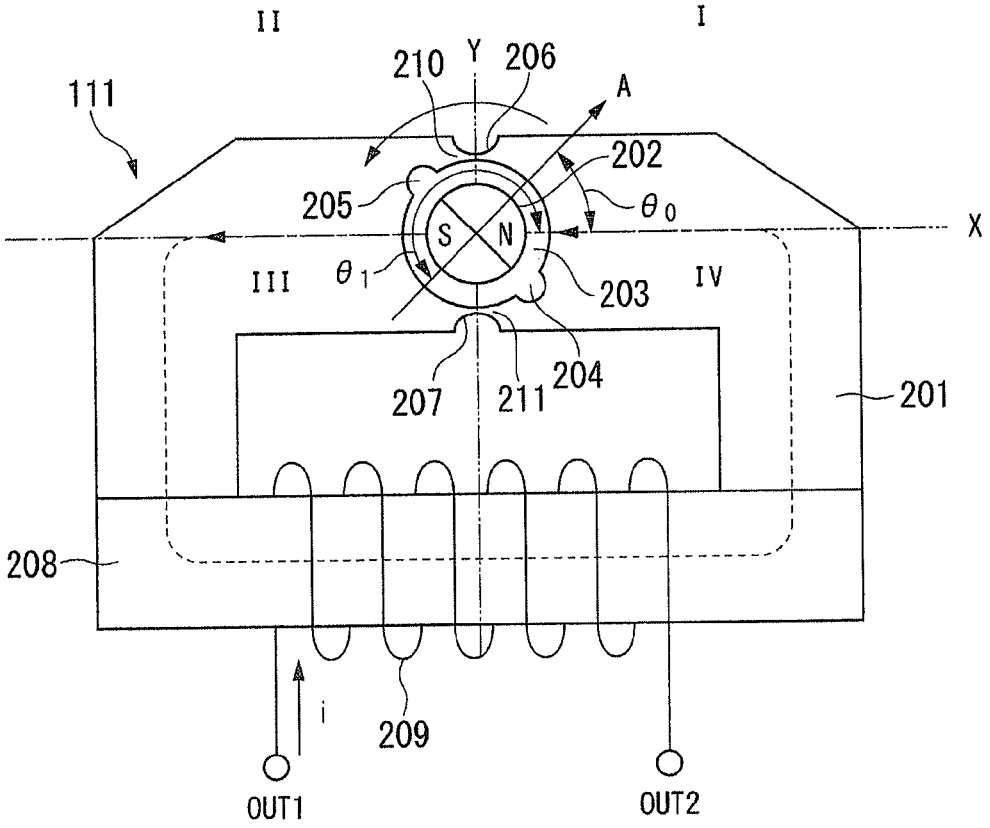
FIG. 3 is a configuration diagram of a motor according to the first embodiment.

FIG. 3 is a configuration diagram of the motor 111 according to the present embodiment.

As illustrated in FIG. 3, the motor 111 includes a stator 201 which has a rotor accommodating through-hole 203, the rotor 202 which is rotatably arranged in the rotor accommodating through-hole 203, a magnetic core 208 which is joined to the stator 201, and a coil 209 which is wound around the magnetic core 208.

In the motor 111, the stator 201 and the magnetic core 208 are fixed to a main plate (not illustrated) and are joined to each other by using a screw (not illustrated) or by mean of heat caulking. The coil 209 has a first terminal OUT1 and a second terminal OUT2.

The rotor 202 is magnetized into two poles (S-pole and N-pole). An outer end portion of the stator 201 formed of a magnetic material has multiple (two according to the example in FIG. 3) cutout portions (outer notches) 206 and 207 at a position where the cutout portions 206 and 207 face each other across the rotor accommodating through-hole 203. Saturable portions 210 and 211 are disposed between the respective outer notches 206 and 207 and the rotor accommodating through-hole 203.

The saturable portions 210 and 211 are not magnetically saturated with a magnetic flux of the rotor 202, and are configured to be magnetically saturated so as to increase magnetic resistance when the coil 209 is energized. The rotor accommodating through-hole 203 is configured to have a circular hole in which multiple (two according to the example in FIG. 3) semicircular cutout portions (inner notches) 204 and 205 are integrally formed in a facing portion of a through-hole whose contour is circular.

The cutout portions 204 and 205 configure a positioning portion for determining a stop position of the rotor 202. In a state where the coil 209 is energized, the rotor 202 stably stops at a position corresponding to the positioning portion as illustrated in FIG. 3. That is, a magnetic pole axis A of the rotor 202 stably stops at a position orthogonal to a line segment which connects the cutout portions 204 and 205 to each other (position of an angle $\theta_0$). The angle $\theta_0$ according to the example illustrated in FIG. 3 is approximately 45 degrees from the x-axis. An XY coordinate space whose center is a rotation axis (rotation center) of the rotor 202 is divided into four quadrants (first quadrant I to fourth quadrant IV).

For example, if a current i is caused to flow in a direction of an arrow in FIG. 3 by supplying the normal forwarding pulse signal having a rectangular wave to a portion between the terminals OUT1 and OUT2 of the coil 209 from the normal forwarding pulse generation unit 109, a magnetic flux is generated in the stator 201 in a direction of a dashed line arrow. Here, for example, the first terminal OUT1 side is set to a positive electrode, and the second terminal OUT2 side is set to a negative electrode.

In this manner, the saturable portions 210 and 211 are saturated so as to increase magnetic resistance. Thereafter, interaction between a magnetic pole generated in the stator 201 and a magnetic pole generated in the rotor 202 causes the rotor 202 to rotate by 180 degrees in the counterclockwise direction, and the magnetic pole axis A stably stops at a position of an angle $\theta_1$. The angle $\theta_1$ according to the example illustrated in FIG. 3 is approximately 225 degrees from the x-axis.

Next, a change in the voltage value in the secondary battery 105 will be described.

Figures 4, 5:
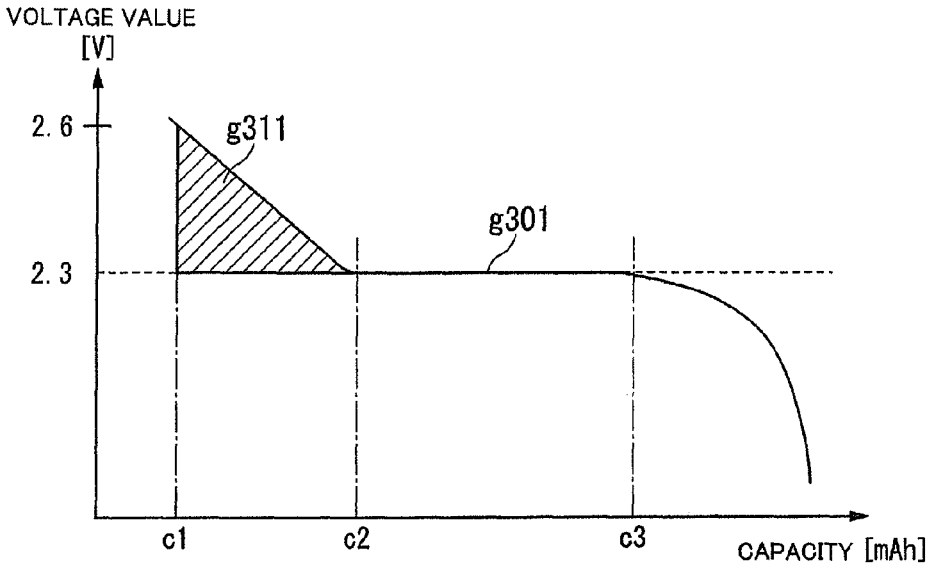
FIG. 4 is a graph for describing an example of a change in a voltage value in a secondary battery according to the first embodiment.
FIG. 5 is a table for describing normal forwarding and fast-forwarding according to the first embodiment.

FIG. 4 is a graph for describing an example of a change in the voltage value in the secondary battery 105 according to the present embodiment. In FIG. 4, the horizontal axis represents capacity [mAh] of the secondary battery 105, and the vertical axis represents a voltage value [V]. A curve g301 represents a relationship between the voltage value and the capacity of the secondary battery 105. The example illustrated in FIG. 4 is an example in a case where recharging is not performed after light is emitted to the solar panel 104 and the secondary battery 105 is fully charged.

According to the example illustrated in FIG. 4, when the capacity is c1, the voltage value is 2.6 V. During a period while the capacity is c1 to c2, the voltage value decreases from 2.6 V to 2.3 V as illustrated by the curve g301, and the capacity also decreases from c1 mAh to c2 mAh. Then, during a period while the capacity is c2 to c3, the voltage value substantially maintains 2.3 V as illustrated by the curve g301. Then, after the capacity is c3, the voltage value continuously decreases from 2.3 V to 0 V as illustrated by the curve g301.

According to the present embodiment, during a first period while the capacity is c1 to c2, electrical energy in a region illustrated by the reference numeral g311 is used for a normal forwarding pulse signal. As in the region illustrated by the reference numeral g311, the voltage value supplied to the normal forwarding pulse generation unit 109 from the control circuit 103 (refer to FIG. 1) during the first period is changed from approximately 2.6 V to 2.3 V.

If the period while the capacity is c2 to c3 is set to a second period, a ratio between the first period and the second period is approximately four to six. In the related art, the voltage of the secondary battery 105 is converted into a constant voltage during the first period. Consequently, the electrical energy in the region illustrated by the reference numeral g311 cannot be effectively utilized. On the other hand, according to the present embodiment, the electrical energy during the first period is used for the normal forwarding pulse signal. Therefore, the electrical energy can be effectively utilized.

Next, normal forwarding and fast-forwarding will be described.

FIG. 5 is a table for describing the normal forwarding and the fast-forwarding according to the present embodiment.

As illustrated in FIG. 5, in a case of the normal forwarding, the motor 111 is driven by using a battery voltage. Accordingly, an average voltage value of the drive voltage is 2.6 V. In this case, when drive control is adopted in order to narrow a pulse width to a rotatable level, power consumption of the motor 111 while the indicating hand is driven shows 1 μW. Then, if the average voltage value of the drive voltage is 2.6 V, current consumption shows approximately 0.38 μA (=1 μW/2.6 V). In addition, in the case of the normal forwarding, a drive frequency shows 1 Hz.

Here, the power consumption when the indicating hand is driven by setting the drive voltage for the normal forwarding to a constant voltage of 2.3 V will be described. In this case, the current consumption shows approximately 0.43 μA (=1 μW/2.3 V).

As described above, according to the present embodiment, the normal forwarding is driven by using the battery voltage. Accordingly, compared to a case where the normal forwarding is driven by using the constant voltage, the current consumption can be reduced down to approximately 0.05 μA (=0.43 μA-0.38 μA). Since the current consumption is reduced, it is possible to lengthen the time which enables the normal forwarding to be driven by the fully charged secondary battery 105. Even during the charging, the current is consumed by the normal forwarding. Therefore, the time required for charging the secondary battery 105 can be shortened by reducing the current consumption of the normal forwarding. In general, in a case of the electronic timepiece 1 for women, which has a small size, a size of the solar panel 104 is smaller than that of the electronic timepiece 1 for men. In this case, the reduced current consumption during the normal forwarding shortens the time required for charging, and lengthens the time which enables the normal forwarding to be driven by using the power of the secondary battery 105. Therefore, a user can obtain a very advantageous effect.

Substantially the same significant difference can be maintained not only in the drive control for narrowing the pulse width to a rotatable level, but also in the drive control for narrowing the pulse width to a range which has room for rotation.

In a case of the fast-forwarding, the motor 111 is driven by using the constant voltage. Accordingly, the voltage value of the drive voltage is 2.3 V. The power consumption of the motor 111 while the indicating hand is driven is approximately 1 μW. Therefore, the current consumption is approximately 0.43 μA (=1 μW/2.3 V). In the case of the fast-forwarding, a threshold drive frequency is 256 Hz. If the drive frequency is higher than 256 Hz, a step-out phenomenon sometimes occurs in the motor 111. Therefore, according to the present embodiment, 256 Hz is the threshold drive frequency.

In the present embodiment, the drive frequency for the fast-forwarding is used in a range of 16 Hz or higher.

Next, process procedures in the normal forwarding and the fast-forwarding of the electronic timepiece 1 will be described.

FIG. 6 is a flowchart of the process procedures in the normal forwarding and the fast-forwarding of the electronic timepiece 1 according to the present embodiment.

Step S1

The control circuit 103 determines whether or not information indicating the fast-forwarding is input from the input unit 113. When the information indicating the fast-forwarding is input, the control circuit 103 determines to perform the fast-forwarding (Step S1: YES), the process proceeds to Step S3. When the information indicating the fast-forwarding is not input, the control circuit 103 determines not to perform the fast-forwarding (Step S1: NO), the process proceeds to Step S2.

Step S2

In order to perform the normal forwarding, the control circuit 103 supplies the battery voltage to the normal forwarding pulse generation unit 109, and outputs the normal forwarding instruction. Then, the normal forwarding pulse generation unit 109 generates the normal forwarding pulse signal by using the supplied battery voltage in accordance with the input normal forwarding instruction. Then, the normal forwarding pulse generation unit 109 outputs the generated normal forwarding pulse signal to the motor 111. In this manner, the control circuit 103 drives the indicating hand 125 so as to be rotated at normal forwarding speed. After the control circuit 103 drives the indicating hand 125 at the normal forwarding speed, the process returns to Step S1.

Step S3

In order to detect the voltage value of the secondary battery 105, the control circuit 103 outputs an instruction to detect the voltage value of the secondary battery 105, to the power source voltage detection circuit 106. Then, the control circuit 103 receives information indicating the voltage value from the power source voltage detection circuit 106. In the control circuit 103, the process proceeds to Step S4.

Step S4

The control circuit 103 determines whether or not the voltage value of the secondary battery 105 is greater than 2.3 V. When the control circuit 103 determines that the voltage value is greater than 2.3 V (Step S4: YES), the process proceeds to Step S5. When the control circuit 103 determine that the voltage value is equal to or smaller than 2.3 V (Step S4: NO), the process proceeds to Step S6.

Step S5

The control circuit 103 supplies the battery voltage to the voltage stabilizer circuit 107. Then, the control circuit 103 outputs the fast-forwarding instruction to the fast-forwarding pulse generation unit 108. Then, the voltage stabilizer circuit 107 converts the input battery voltage into the constant voltage, and supplies the converted constant voltage to the fast-forwarding pulse generation unit 108. Then, the fast-forwarding pulse generation unit 108 generates the fast-forwarding pulse signal by using the supplied constant voltage in accordance with the input fast-forwarding instruction. Then, the fast-forwarding pulse generation unit 108 outputs the generated fast-forwarding pulse signal to the motor 111, thereby driving the indicating hand 125 so as to be rotated at fast-forwarding speed. After the control circuit 103 drives the indicating hand 125 at the fast-forwarding speed, the process returns to Step S1. The process procedure illustrated in Step S5 is an example, and the process order may be different therefrom.

Step S6

The control circuit 103 supplies the battery voltage to the fast-forwarding pulse generation unit 108. Then, the control circuit 103 outputs the fast-forwarding instruction to the fast-forwarding pulse generation unit 108. Then, the fast-forwarding pulse generation unit 108 generates the fast-forwarding pulse signal by using the supplied battery voltage in accordance with the input fast-forwarding instruction. Then, the fast-forwarding pulse generation unit 108 outputs the generated fast-forwarding pulse signal to the motor 111, thereby driving the indicating hand 125 so as to be rotated at fast-forwarding speed. After the control circuit 103 drives the indicating hand 125 at the fast-forwarding speed, the process returns to Step S1. The process procedure illustrated in Step S6 is an example, and the process order may be different therefrom.

The electronic timepiece 1 performs the above-described normal forwarding process once per second, and performs the fast-forwarding process when the fast-forwarding instruction is input from the input unit 113.

Here, an operation example of an electronic timepiece using the related art will be described.

The electronic timepiece in the related art has a solar panel, a secondary battery, a control circuit, a power source voltage detection circuit, a voltage stabilizer circuit, a fast-forwarding pulse generation unit, a normal forwarding pulse generation unit, an auxiliary drive pulse generation unit, a motor, a rotation detection/determination circuit, an input unit, a dial, and an indicating hand.

A difference from the electronic timepiece 1 illustrated in FIG. 1 is a voltage used in the normal forwarding. In addition, the power source voltage detection circuit measures the voltage of the secondary battery at predetermined time intervals, and outputs information indicating the measured voltage value to the control circuit.

FIG. 7 is a flowchart of process procedures in the normal forwarding and the fast-forwarding of the electronic timepiece in the related art.

Step S11

The control circuit detects the voltage value of the secondary battery by receiving the information indicating the voltage value of the secondary battery.

Step S12

The control circuit determines whether or not the voltage value of the secondary battery is greater than 2.3 V. When the control circuit determines that the voltage value is greater than 2.3 V (Step S12: YES), the process proceeds to Step S13. When the control circuit determine that the voltage value is equal to or smaller than 2.3 V (Step S13: NO), the process proceeds to Step S14.

Step S13

The control circuit supplies the battery voltage to the voltage stabilizer circuit. Then, when the fast-forwarding instruction is input from the input unit, the control circuit outputs the fast-forwarding instruction to the fast-forwarding pulse generation unit. When the fast-forwarding instruction is not input from the input unit, the control circuit outputs the normal forwarding instruction to the normal forwarding pulse generation unit. Then, the voltage stabilizer circuit converts the input battery voltage into the constant voltage, and supplies the converted constant voltage to the fast-forwarding pulse generation unit and the normal forwarding pulse generation unit. Then, when the fast-forwarding instruction is input, the fast-forwarding pulse generation unit generates the fast-forwarding pulse signal by using the supplied constant voltage in accordance with the input fast-forwarding instruction. Then, the fast-forwarding pulse generation unit outputs the generated fast-forwarding pulse signal to the motor, thereby driving the indicating hand at fast-forwarding speed. Alternatively, when the fast-forwarding instruction is not input, the normal forwarding pulse generation unit generates the normal forwarding pulse signal by using the supplied constant voltage in accordance with the input normal forwarding instruction. Then, the normal forwarding pulse generation unit outputs the generated normal forwarding pulse signal to the motor, thereby driving the indicting hand at normal forwarding speed. After the control circuit performs the normal forwarding or the fast-forwarding, the process proceeds to Step S11.

Step S14

The control circuit supplies the battery voltage to the fast-forwarding pulse generation unit and the normal forwarding pulse generation unit. Then, when the fast-forwarding instruction is input from the input unit, the control circuit outputs the fast-forwarding instruction to the fast-forwarding pulse generation unit. When the fast-forwarding instruction is not input from the input unit, the control circuit outputs the normal forwarding instruction to the normal forwarding pulse generation unit. Then, when the fast-forwarding instruction is input, the fast-forwarding pulse generation unit generates the fast-forwarding pulse signal by using the supplied constant voltage in accordance with the input fast-forwarding instruction. Then, the fast-forwarding pulse generation unit outputs the generated fast-forwarding pulse signal to the motor, thereby driving the indicating hand at fast-forwarding speed. Alternatively, when the fast-forwarding instruction is not input, the normal forwarding pulse generation unit generates the normal forwarding pulse signal by using the supplied constant voltage in accordance with the input normal forwarding instruction. Then, the normal forwarding pulse generation unit outputs the generated normal forwarding pulse signal to the motor, thereby driving the indicting hand at normal forwarding speed. After the control circuit performs the normal forwarding or the fast-forwarding, the process proceeds to Step S11.

As described above, according to the electronic timepiece in the related art, if the voltage value of the secondary battery is greater than 2.3 V, the normal forwarding and the fast-forwarding are driven by using the constant voltage. Then, if the voltage value of the secondary battery is equal to or smaller than 2.3 V, the normal forwarding and the fast-forwarding are driven by using the battery voltage. Consequently, according to the electronic timepiece in the related art, electrical energy in the region (first region) illustrated by the reference numeral g311 in FIG. 4 cannot be effectively utilized. According to the electronic timepiece in the related art, when the voltage value of the secondary battery is greater than 2.3 V, the normal forwarding is also driven by using the constant voltage as illustrated in FIG. 7. Consequently, compared to the electronic timepiece 1 according to the present embodiment, the current consumption increases during the normal forwarding. For example, a user performs the fast-forwarding operation when he or she wants to adjust the time. Accordingly, in general, the electronic timepiece is not frequently brought into the fast-forwarding state. On the other hand, since the electronic timepiece usually clocks the time, the electronic timepiece is frequently brought into the normal forwarding state. Therefore, the current consumption during the normal forwarding occupies most of the current consumption in the electronic timepiece. Therefore, according to the electronic timepiece 1 in the present embodiment, as described referring to FIG. 6, the normal forwarding operation is performed by using the voltage of the battery. In this manner, the current consumption can be reduced. In particular, according to the present embodiment, the first region can be arranged as a region where a high voltage is output by a solar cell, for example. Accordingly, the current consumption during the normal hand operation can be efficiently suppressed. Therefore, according to the present embodiment, the current consumption is suppressed during the normal hand operation when the indicating hand is frequently driven. In this manner, even if the electronic timepiece performs the fast-forwarding, the battery life can effectively last longer. Furthermore, according to the present embodiment, the high voltage similar to that used during the normal hand operation is not used during the fast-forwarding hand operation. Accordingly, even during the fast-forwarding hand operation, the step-out of the motor 111 can be suppressed. Therefore, according to the present embodiment, it is possible to provide the electronic timepiece 1 which can be driven at fast-forwarding speed while low power consumption and fast speed can be achieved at the same time.

Furthermore, according to the electronic timepiece in the related art, the power source voltage detection circuit detects the voltage value of the secondary battery at predetermined time intervals. Consequently, the power is consumed by the power source voltage detection circuit at predetermined time intervals. On the other hand, as described referring to FIG. 6, the electronic timepiece 1 in the present embodiment instructs the power source voltage detection circuit to detect the voltage value of the secondary battery when the fast-forwarding instruction is input. As a result, according to the electronic timepiece 1 in the present embodiment, since the power source voltage detection circuit detects the voltage value when the fast-forwarding instruction is input, the power consumption of the power source voltage detection circuit can be reduced.

As described above, the electronic timepiece 1 in the present embodiment includes the battery (for example, the solar panel 104 and the secondary battery 105), the voltage stabilizer circuit (for example, the voltage stabilizer circuit 107) that generates the constant voltage (for example, 2.3 V) by using the power supplied from the battery, and the control circuit (for example, the control circuit 103) that clocks the time by driving the rotating body (for example, the indicating hand or the disc) at the first hand operation speed (for example, normal forwarding speed at which the rotating body is driven) and at the second hand operation speed (for example, fast-forwarding speed at which the rotating body is driven). In a case of the first hand operation speed, the control circuit drives the rotating body by using the voltage (for example, 2.6 V to 2.3 V) of the battery including the first region (for example, the region illustrated by the reference numeral g311 in FIG. 4) where the detected voltage value is equal to or greater than the voltage value of the constant voltage. In a case of the second hand operation speed, the control circuit drives the rotating body by using the constant voltage.

According to this configuration, the electronic timepiece 1 in the present embodiment can further reduce the current consumption of the motor 111 when the normal forwarding is performed, compared to the electronic timepiece in the related art which is driven by using the constant voltage. In this manner, the electronic timepiece 1 in the present embodiment can further lengthen the driving time of the secondary battery 105, compared to the electronic timepiece in the related art. Furthermore, according to the electronic timepiece 1 in the present embodiment, the normal forwarding operation is performed even during the charging. Accordingly, the current consumption of the motor 111 can be reduced when the normal forwarding operation is performed. Therefore, it is possible to shorten the time required for charging the secondary battery.

The electronic timepiece 1 in the present embodiment includes the detection unit (for example, the power source voltage detection circuit 106) that detects the voltage value of the battery (for example, the solar panel 104 and the secondary battery 105). In a case of the first region (for example, the region where the capacity is c1 to c3 in FIG. 4) where the detected voltage of the battery is equal to or greater than the voltage value of the constant voltage (for example, 2.3 V), the control circuit (for example, the control circuit 103) drives the indicating hand at the second hand operation speed (for example, the fast-forwarding speed) by using the constant voltage. In a case of the second region (for example, the region where the capacity is equal to or smaller than c3 in FIG. 4) where the detected voltage value of the battery is equal to or smaller than the voltage value of the constant voltage, the control circuit switches the driving so as to drive the indicating hand at the second hand operation speed by using the voltage of the battery.

According to this configuration, when the voltage value of the secondary battery 105 is greater than the voltage value of the constant voltage, the electronic timepiece 1 in the present embodiment directly uses the voltage of the secondary battery 105 without discharging electricity or converting the voltage of the battery into the constant voltage. Therefore, electrical energy in the region (first region) illustrated by the reference numeral g311 in FIG. 4 can be effectively utilized.

The electronic timepiece 1 in the present embodiment includes the input unit (for example, the input unit 113) that receives a user's operation. The detection unit (for example, the power source voltage detection circuit 106) detects the voltage value of the battery, when the user's operation received by the input unit shows the instruction to drive the indicating hand at the second hand operation speed (for example, the fast-forwarding speed).

According to this configuration, when the fast-forwarding instruction is input, the electronic timepiece 1 according to the present embodiment instructs the power source voltage detection circuit to detect the voltage value of the secondary battery. As a result, according to the electronic timepiece 1 in the present embodiment, the power source voltage detection circuit detects the voltage value when the fast-forwarding instruction is input. Therefore, the power consumption of the power source voltage detection circuit can also be reduced.

The electronic timepiece 1 according to the present embodiment drives the rotating body (for example, the indicating hand or the disc) at the first hand operation speed (for example, the normal forwarding speed) so as to be rotated at speed corresponding to time clocking. The electronic timepiece 1 according to the present embodiment drives the rotating body at the second hand operation speed (for example, the fast-forwarding speed) which is faster than the first hand operation speed so as to be rotated to a predetermined position (for example, the initial position, the position indicating 12 o'clock).

According to this configuration, in a case of the normal forwarding, the electronic timepiece 1 in the present embodiment can rotate the indicating hand or the disc at speed corresponding to time clocking. In a case of the fast-forwarding, the electronic timepiece 1 in the present embodiment can rotate the indicating hand or the disc at speed which is faster than the normal forwarding speed so as to reach the predetermined position.

According to the electronic timepiece 1 in the present embodiment, the second hand operation speed (for example, the fast-forwarding speed at which the rotating body is driven) is the speed at which the electronic timepiece 1 is driven by using the frequency which can suppress the step-out of the rotating body (for example, the indicating hand or the disc).

According to this configuration, the electronic timepiece 1 in the present embodiment can suppress the step-out of the indicating hand or the disc.

According to the electronic timepiece 1 in the present embodiment, the rotating body (for example, the indicating hand or the disc) which is driven at the second hand operation speed (for example, the fast-forwarding speed) performs a forward rotation operation and a reverse rotation operation.

According to this configuration, the electronic timepiece 1 in the present embodiment can rotate the indicating hand or the disc which is driven at the fast-forwarding speed in a forward rotation direction or in a reverse rotation direction so as to reach the predetermined position.

Second Embodiment

In the first embodiment, an example has been described in which the control circuit performs the normal forwarding driving by using the battery voltage, performs the fast-forwarding driving by using the battery voltage when the voltage value of the battery voltage (hereinafter, also referred to as a battery voltage value) is greater than the voltage value of the constant voltage (for example, 2.3 V) (hereinafter, also referred to as a constant voltage value), and performs the fast-forwarding driving by using a lower voltage when the battery voltage value is equal to or smaller than the constant voltage value. In the present embodiment, an example will be described in which a control circuit controls a normal forwarding operation and a fast-forwarding operation by using two threshold values for the battery voltage value.

Figure 8:
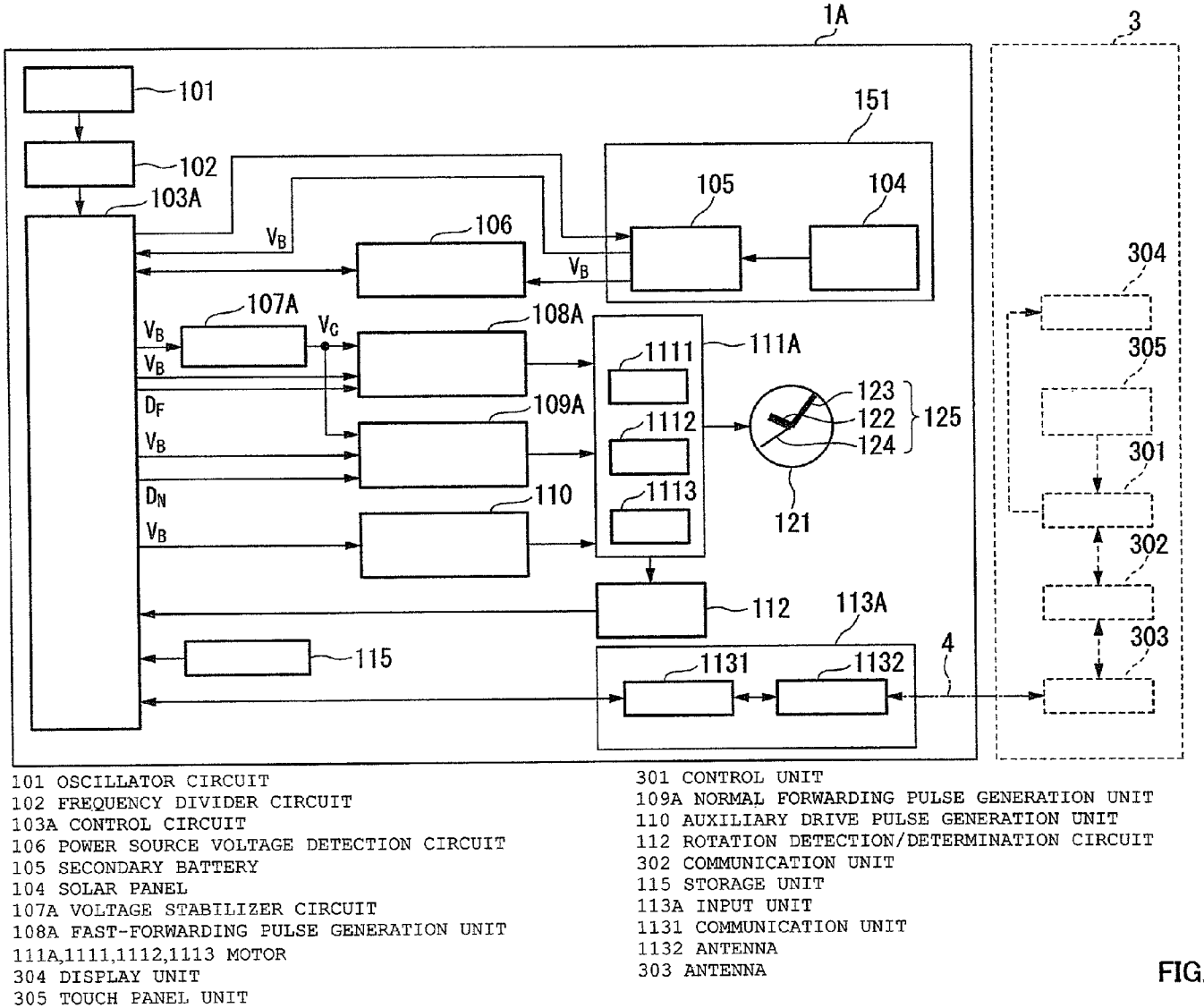
FIG. 8 is a block diagram illustrating a configuration of an electronic timepiece according to a second embodiment.

FIG. 8 is a block diagram illustrating an electronic timepiece 1A according to the present embodiment. As illustrated in FIG. 8, the electronic timepiece 1A is configured to include the oscillator circuit 101, the frequency divider circuit 102, a control circuit 103A, a solar power source 151, the power source voltage detection circuit 106, a voltage stabilizer circuit 107A, a fast-forwarding pulse generation unit 108A, a normal forwarding pulse generation unit 109A, the auxiliary drive pulse generation unit 110, a motor 111A, the rotation detection/determination circuit 112, an input unit 113A, a storage unit 115, the dial 121, the hour hand 122, the minute hand 123, and the second hand 124. In addition, the solar power source 151 includes the solar panel 104 and the secondary battery 105. In the first embodiment, the solar panel 104 and the secondary battery 105 are also referred to as the solar power source. The same reference numerals are given to functional units which have the same function as that of the electronic timepiece 1, and description thereof will be omitted.

The electronic timepiece 1A is connected to a terminal 3, and receives an instruction from the terminal 3. In the present embodiment, an example will be described in which the electronic timepiece 1A and the terminal 3 perform short-distance communication therebetween, for example, wireless communication using a communication system based on a standard of Bluetooth (registered trademark) Low Energy (LE, hereinafter, referred to as BLE). However, another wireless communication system may be adopted, or a wired communication system may be adopted.

Configuration of Terminal 3

First, the terminal 3 will be described.

The terminal 3 has a communication function using the communication system based on the BLE standard. For example, the terminal 3 includes smartphones, tablet terminals, portable game machines, and the like.

The terminal 3 includes a control unit 301, a communication unit 302, an antenna 303, a display unit 304, and a touch panel unit 305.

The control unit 301 controls each functional unit of the terminal 3. The control unit 301 causes the display unit 304 to display an image corresponding to applications or settings which are installed in the terminal 3. The applications or settings include an instruction to start pairing of the communication system based on the BLE standard, and an instruction to adjust the time. The control unit 301 receives an operation result detected by the touch panel unit 305. In accordance with the operation result, the control unit 301 performs communication with the electronic timepiece 1A via the communication unit 302 and the antenna 303 by using the communication system based on the BLE standard. For example, the communication of the electronic timepiece 1A includes communication for a pairing process between the electronic timepiece 1A and the terminal 3, an instruction given from the terminal 3 to the electronic timepiece 1A, and response made from the electronic timepiece 1A to the terminal 3.

Based on the control of the control unit 301, the communication unit 302 transmits or receives information 4 to or from the electronic timepiece 1A via the antenna 303.

The antenna 303 spatially transmits an electric signal with a bandwidth of 2.4 GHz which is output from the communication unit 302, as a radio wave. The antenna 303 receives a radio wave with a bandwidth of 2.4 GHz which is received by the electronic timepiece 1A, converts the received radio wave into an electrical signal, and outputs the converted electrical signal to the communication unit 302.

The display unit 304 displays an image output from the control unit 301. For example, the display unit 304 is a liquid crystal panel, and has a backlight.

The touch panel unit 305 is a touch panel type of sensor disposed on the display unit 304, detects a user's operation, and outputs the detected operation result to the control unit 301.

Configuration of Electronic Timepiece 1A

Next, the electronic timepiece 1A will be described.

The secondary battery 105 supplies the control circuit 103A with power of voltage $V_B$ full of electrical energy supplied from the solar panel 104 (also referred to as a solar cell), and outputs the power to the power source voltage detection circuit 106.

The voltage stabilizer circuit 107A supplies the converted constant voltage to the fast-forwarding pulse generation unit 108A and the normal forwarding pulse generation unit 109A.

The motor 111A includes a motor 1111, a motor 1112, and a motor 1113.

The motor 1111 drives the hour hand 122 in accordance with the fast-forwarding pulse signal output from the fast-forwarding pulse generation unit 108A or the normal forwarding pulse signal output from the normal forwarding pulse generation unit 109A.

The motor 1112 drives the minute hand 123 in accordance with the fast-forwarding pulse signal output from the fast-forwarding pulse generation unit 108A or the normal forwarding pulse signal output from the normal forwarding pulse generation unit 109A.

The motor 1113 drives the second hand 124 in accordance with the fast-forwarding pulse signal output from the fast-forwarding pulse generation unit 108A or the normal forwarding pulse signal output from the normal forwarding pulse generation unit 109A.

When a fast-forwarding instruction $D_F$ is input from the control circuit 103A, the fast-forwarding pulse generation unit 108A generates the fast-forwarding pulse signal by using the battery voltage $V_B$ supplied from the control circuit 103A or a constant voltage $V_C$ supplied from the voltage stabilizer circuit 107A in accordance with the fast-forwarding instruction $D_F$ input from the control circuit 103A. Here, when the voltage value of the secondary battery 105 is greater than 2.3 V, the drive voltage value is 2.3 V of the constant voltage. When the voltage value of the secondary battery 105 is equal to or smaller than 2.3 V, the drive voltage value is the voltage value (however, equal to or smaller than 2.3 V) of the secondary battery 105. The fast-forwarding pulse generation unit 108A outputs the generated fast-forwarding pulse signal to the motor 111A.

When a normal forwarding instruction $D_N$ is input from the control circuit 103A, the normal forwarding pulse generation unit 109A generates the normal forwarding pulse signal for driving the second hand 124 by using the battery voltage $V_B$ supplied from the control circuit 103A in accordance with the normal forwarding instruction input from the control circuit 103A. In addition, when the normal forwarding instruction $D_N$ is input from the control circuit 103A, the normal forwarding pulse generation unit 109A generates the normal forwarding pulse signal for driving the minute hand 123 and the hour hand 122 by using the constant voltage $V_C$ supplied from the voltage stabilizer circuit 107A in accordance with the normal forwarding instruction $D_N$ input from the control circuit 103A. The normal forwarding pulse generation unit 109A outputs the generated normal forwarding pulse signal to the motor 111A.

For example, when the time is displayed, the second hand 124 is driven once per second, the minute hand 123 is driven once in ten seconds, and the hour hand 122 is driven once in ten minutes. As described above, the driving of the second hand 124 has the strongest influence on the power consumption. Therefore, according to the present embodiment, only the second hand 124 is driven by using the battery voltage $V_B$ during the normal driving. In this manner, the battery power can be effectively used. Furthermore, according to the present embodiment, even when the battery voltage $V_B$ is higher than the constant voltage $V_C$, the minute hand 123 and the hour hand 122 are driven by using the constant voltage $V_C$. In this manner, the minute hand 123 and the hour hand 122 can be driven by using stable torque.

Even in the first embodiment, when the battery voltage $V_B$ is higher than the constant voltage $V_C$, only the second hand 124 may be driven by using the battery voltage $V_B$, and the minute hand 123 and the hour hand 122 may be driven by using the constant voltage $V_C$.

The storage unit 115 stores a first threshold value $V_{ref1}$ and a second threshold value $V_{ref2}$ as illustrated in FIG. 9. FIG. 9 is a table illustrating an example of the first threshold value and the second threshold value which are stored in the storage unit 115 according to the present embodiment. FIG. 10 is a table illustrating a relationship among the battery voltage, the threshold value, the voltage used in the normal forwarding operation, and the voltage used in the fast-forwarding operation, which are stored in the storage unit 115 according to the present embodiment. As illustrated in FIG. 10, the storage unit 115 stores the battery voltage value, the threshold values (the first threshold value $V_{ref1}$ and the second threshold value $V_{ref2}$), the voltage used in the normal forwarding operation for the second hand which are associated with each other, and the battery voltage value, the threshold values, the voltage used in the fast-forwarding operation which are associated with each other. As illustrated in FIG. 10, when the battery voltage value is greater than the first threshold value $V_{ref1}$, the voltage used in the normal forwarding operation for the second hand is the battery voltage, and the voltage used in the fast-forwarding operation is the constant voltage. In addition, when the battery voltage value is equal to or smaller than the first threshold value $V_{ref1}$ and equal to or greater than the second threshold value $V_{ref2}$, the voltage used in the normal forwarding operation for the second hand is the battery voltage, and the voltage used in the fast-forwarding operation is the battery voltage. Furthermore, when the battery voltage value is smaller than the second threshold value $V_{ref2}$, the voltage used in the normal forwarding operation for the second hand is the battery voltage, and the voltage is not supplied for the fast-forwarding operation. For example, the voltage value of the first threshold value $V_{ref1}$ is 2.6 V. For example, the voltage value of the second threshold value $V_{ref2}$ is 2.0 V.

The above-described value of each threshold value is an example, and is not limited thereto. For example, the voltage value of the first threshold value $V_{ref1}$ may be in a range from 2.4 V to 2.2 V. For example, the voltage value of the second threshold value $V_{ref2}$ may be in a range from 2.1 V to 1.9 V.

Figures 11, 12:
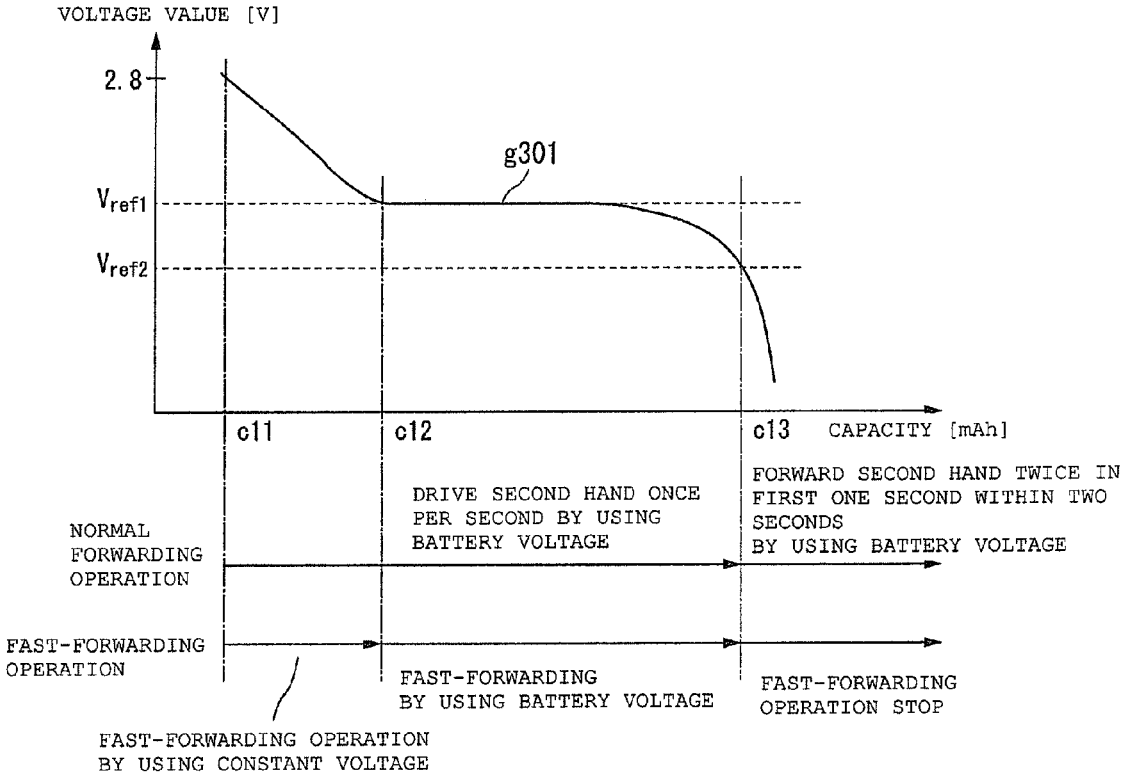
FIG. 11 is a table illustrating an example of a voltage value of a constant voltage, the first threshold value, and the second threshold value during forward rotation and reverse rotation, which are stored in the storage unit according to the second embodiment.
FIG. 12 is a graph for describing a relationship between a battery voltage value and the normal forwarding, and a relationship between the battery voltage value and the fast-forwarding according to the second embodiment.

If a method for driving the motor 111 varies during the forward rotation and during the reverse rotation (for example, refer to JP-A-2014-117028), the voltage value needed to drive the motor 111 varies in some cases. In this case, the constant voltage $V_C$, the first threshold value $V_{ref1}$, and the second threshold value $V_{ref2}$ may vary during the forward rotation and during the reverse rotation as illustrated in FIG. 11. FIG. 11 is a table illustrating an example of the voltage value of the constant voltage, the first threshold value, and the second threshold value during the forward rotation and during the reverse rotation, which are stored in the storage unit 115 according to the present embodiment. As illustrated in FIG. 11, the storage unit 115 stores the voltage value of the constant voltage, the first threshold value, and the second threshold value during the forward rotation, which are associated with each other. In addition, the storage unit 115 stores the voltage value of the constant voltage, the first threshold value, and the second threshold value during the reverse rotation, which are associated with each other. In this case, in accordance with the rotating direction detected by the rotation detection/determination circuit 112 or in accordance with the rotating direction corresponding to the instruction input from the input unit 113A, the control circuit 103A may switch the constant voltage $V_C$, the first threshold value $V_{ref1}$, and the second threshold value $V_{ref2}$ during the forward rotation and during the reverse rotation. Alternatively, during the reverse rotation, the control circuit 103A may select only the second threshold value $V_{ref2}$ used during the forward rotation, and may switch between the voltage used in the normal forwarding operation and the voltage used in the fast-forwarding operation by using the selected second threshold value $V_{ref2}$. For example, when the battery voltage value is equal to or greater than the second threshold value $V_{ref2}$, the battery voltage may be used in the normal forwarding operation and the fast-forwarding operation. Then, when the battery voltage value is smaller than the second threshold value $V_{ref2}$, the normal forwarding operation may be performed in a low voltage operation mode, and the fast-forwarding operation may be stopped, or may not be performed.

For example, the control circuit 103A may determine whether to cause the motor 111 to perform the forward rotation or the reverse rotation by comparing the displayed current time with the adjusted time input from the input unit 113A.

Referring back to FIG. 8, the electronic timepiece 1A will be continuously described.

The input unit 113A includes a communication unit 1131 and an antenna 1132.

The communication unit 1131 communicates with the terminal 3 via the antenna 1132 in accordance with the control of the control circuit 103A.

The antenna 1132 spatially transmits an electric signal with a bandwidth of 2.4 GHz which is output from the communication unit 1131, as a radio wave. The antenna 1132 receives a radio wave with a bandwidth of 2.4 GHz which is received by the terminal 3, converts the received radio wave into an electrical signal, and outputs the converted electrical signal to the communication unit 1131.

The input unit 113A may include a crown or a push switch. A user may adjust the time by operating the crown, or may give the instruction to adjust the time by operating the terminal 3 so as to transmit the fast-forwarding instruction from the terminal 3 to the electronic timepiece 1A.

The control circuit 103A performs the following process within the processes of the control circuit 103, instead of the process performed when information is input from the input unit 113A. When a paring instruction is input from the input unit 113A, the control circuit 103A performs a pairing process in accordance with the communication system based on the BLE standard.

When the information indicating the fast-forwarding is input from the input unit 113A, the control circuit 103A compares the battery voltage value and the first threshold value $V_{ref1}$ or the second threshold value $V_{ref2}$ with each other. When the battery voltage value is equal to or greater than the first threshold value $V_{ref1}$, the control circuit 103A supplies the battery voltage to the voltage stabilizer circuit 107A. When the battery voltage value is smaller than first threshold value $V_{ref1}$, and greater than the second threshold value $V_{ref2}$, the control circuit 103A supplies the battery voltage to the fast-forwarding pulse generation unit 108A. When the battery voltage value is equal to or smaller than second threshold value $V_{ref2}$, the control circuit 103A does not supply the battery voltage to the voltage stabilizer circuit 107A and the fast-forwarding pulse generation unit 108A. When the information indicating the fast-forwarding is input from the input unit 113A, the control circuit 103A outputs the fast-forwarding instruction $D_F$ to the fast-forwarding pulse generation unit 108A.

In a case of the normal forwarding state, the control circuit 103A supplies the battery voltage to the normal forwarding pulse generation unit 109A. The control circuit 103A compares the battery voltage vale and the first threshold value $V_{ref1}$ or the second threshold value $V_{ref2}$ with each other. When the battery voltage value is greater than the second threshold value $V_{ref2}$, the control circuit 103A outputs a pulse generation instruction $D_N$ to the normal forwarding pulse generation unit 109A so as to forward the second hand 124 once per second. When the battery voltage value is equal to or smaller than the second threshold value $V_{ref2}$, the control circuit 103A outputs the pulse generation instruction $D_N$ to the normal forwarding pulse generation unit 109A so as to forward the second hand 124 twice in the first one second within two seconds (low voltage operation mode).

When the fast-forwarding instruction $D_F$ is input from the control circuit 103A, the fast-forwarding pulse generation unit 108A generates the fast-forwarding pulse signal by using the battery voltage $V_B$ supplied from the control circuit 103A or the constant voltage $V_C$ supplied from the voltage stabilizer circuit 107A. The fast-forwarding pulse generation unit 108A outputs the generated fast-forwarding pulse signal to the motor 111A. When the battery voltage $V_B$ or the constant voltage $V_C$ is not supplied, the fast-forwarding pulse generation unit 108A does not generate the fast-forwarding pulse signal.

When the normal forwarding instruction $D_N$ is input from the control circuit 103A, the normal forwarding pulse generation unit 109A generates the normal forwarding pulse signal by using the battery voltage $V_B$ supplied from the control circuit 103A. The normal forwarding pulse generation unit 109A outputs the generated normal forwarding pulse signal to the motor 111A. Specifically, when the pulse generation instruction $D_N$ is input so as to forward the second hand 124 once per second, the normal forwarding pulse generation unit 109A generates a pulse so as to forward the second hand 124 once per second. Alternatively, when the pulse generation instruction $D_N$ is input so as to forward the second hand 124 twice in the first one second within two seconds, the normal forwarding pulse generation unit 109A generates a pulse so as to forward the second hand 124 twice in the first one second within two seconds.

That is, according to the present embodiment, regardless of the voltage of the battery voltage $V_B$, the battery voltage $V_B$ is supplied to the normal forwarding pulse generation unit 109A from the control circuit 103A.

On the other hand, when the battery voltage $V_B$ is greater than the first threshold value $V_{ref1}$, the constant voltage $V_C$ is supplied to the fast-forwarding pulse generation unit 108A via the voltage stabilizer circuit 107A. When the battery voltage $V_B$ is equal to or smaller than the first threshold value $V_{ref1}$ and equal to or greater than the second threshold value $V_{ref2}$, the battery voltage $V_B$ is supplied to the fast-forwarding pulse generation unit 108A. Furthermore, when the battery voltage $V_B$ is smaller than the second threshold value $V_{ref2}$, the battery voltage value $V_B$ and the constant voltage $V_C$ are not supplied to the fast-forwarding pulse generation unit 108A.

Relationship between Battery Voltage Value and Normal Forwarding, and Relationship between Battery Voltage Value and Fast-Forwarding Next, a relationship between the battery voltage value and the normal forwarding and a relationship between the battery voltage value and the fast-forwarding will be described.

FIG. 12 is a graph for describing the relationship between the battery voltage value and the normal forwarding, and the relationship between the battery voltage value and the fast-forwarding according to the present embodiment. The vertical axis and the horizontal axis in FIG. 12 are the same as those in FIG. 4.

When the battery voltage value is greater than the first threshold value $V_{ref1}$ (region where the capacity is c11 to c12), the normal forwarding operation is driven by using the battery voltage $V_B$, and the fast-forwarding operation is driven by using the constant voltage $V_C$. For example, the second hand 124 is driven once per second by the normal forwarding pulse generated by using the battery voltage $V_B$, and the indicating hand 125 is driven by the fast-forwarding pulse generated by using the constant voltage $V_C$.

When the battery voltage value is equal to or smaller than the first threshold value $V_{ref1}$ and equal to or greater than the second threshold value $V_{ref2}$, the normal forwarding operation is driven by using the battery voltage $V_B$, and the fast-forwarding operation is driven by using the battery voltage $V_B$. For example, the second hand 124 is driven once per second by the normal forwarding pulse generated by using the battery voltage $V_B$, and the indicating hand 125 is driven by the fast-forwarding pulse generated by using the battery voltage $V_B$.

When the battery voltage value is smaller than the second threshold value $V_{ref2}$, the normal forwarding operation is driven in a low voltage mode by using the battery voltage $V_B$. For example, the second hand 124 is driven twice in the first one second within two seconds by using the battery voltage $V_B$, and the indicating hand 125 stops the fast-forwarding operation without driving the fast-forwarding operation.

Process Procedures in Normal Forwarding and Fast-Forwarding

Next, process procedures in the normal forwarding and the fast-forwarding of the electronic timepiece 1A will be described.

FIG. 13 is a flowchart of the process procedures in the normal forwarding and the fast-forwarding of the electronic timepiece 1A according to the present embodiment.

Step S101

In order to detect the voltage value of the secondary battery 105, the control circuit 103A outputs an instruction to detect the voltage value of the secondary battery 105, to the power source voltage detection circuit 106. Next, the control circuit 103A receives information indicating the battery voltage value from the power source voltage detection circuit 106.

Step S102

The control circuit 103A compares the received battery voltage value with the first threshold value $V_{ref1}$ and the second threshold value $V_{ref2}$.

Step S103

When the battery voltage value is greater than the first threshold value $V_{ref1}$, the process of the control circuit 103A proceeds to Step S104. When the battery voltage value is equal to or smaller than the first threshold value $V_{ref1}$ and equal to or greater than the second threshold value $V_{ref2}$, the process proceeds to Step S107. When the battery voltage value is smaller than the second threshold value $V_{ref2}$, the process of the control circuit 103A proceeds to Step S109.

Step S104

The control circuit 103A determines whether or not information indicating the fast-forwarding is input from the input unit 113A. When the information indicating the fast-forwarding is input, the control circuit 103A determines to perform the fast-forwarding (Step S104: YES), and the process proceeds to Step S105. When the information indicating the fast-forwarding is not input, the control circuit 103A determines not to perform the fast-forwarding (Step S104: NO), and the process proceeds to Step S106.

Step S105

The control circuit 103A outputs the instruction $D_F$ to generate the fast-forwarding pulse by using the constant voltage $V_C$, to the fast-forwarding pulse generation unit 108A, and performs the fast-forwarding driving on the indicating hand 125 by using the generated fast-forwarding pulse. After the control circuit 103A completes the fast-forwarding process, the process returns to Step S101.

Step S106

The control circuit 103A outputs the instruction $D_N$ to generate the normal forwarding pulse by using the battery voltage $V_B$, to the normal forwarding pulse generation unit 109A, and performs the normal forwarding driving on the second hand 124 by using the generated normal forwarding pulse. After the control circuit 103A completes the normal forwarding process, the process returns to Step S101.

Step S107

The control circuit 103A determines whether or not information indicating the fast-forwarding is input from the input unit 113A. When the information indicating the fast-forwarding is input, the control circuit 103A determines to perform the fast-forwarding (Step S107: YES), and the process proceeds to Step S108. When the information indicating the fast-forwarding is not input, the control circuit 103A determines not to perform the fast-forwarding (Step S107: NO), and the process proceeds to Step S106.

Step S108

The control circuit 103A outputs the instruction $D_F$ to generate the fast-forwarding pulse by using the battery voltage $V_B$, to the fast-forwarding pulse generation unit 108A, and performs the fast-forwarding driving on the indicating hand 125 by using the generated fast-forwarding pulse. After the control circuit 103A completes the fast-forwarding process, the process returns to Step S101.

Step S109

The control circuit 103A determines whether or not information indicating the fast-forwarding is input from the input unit 113A. When the information indicating the fast-forwarding is input, the control circuit 103A determines to perform the fast-forwarding (Step S109: YES), and the process proceeds to Step S110. When the information indicating the fast-forwarding is not input, the control circuit 103A determines not to perform the fast-forwarding (Step S110: NO), and the process proceeds to Step S111.

Step S110

The control circuit 103A does not supply the battery voltage $V_B$ and the constant voltage $V_C$ to the fast-forwarding pulse generation unit 108A. Then, the control circuit 103A does not perform the fast-forwarding driving on the indicating hand 125. The process of the control circuit 103A returns to Step S101.

Step S111

The control circuit 103A outputs the instruction $D_N$ to generate the normal forwarding pulse by using the battery voltage $V_B$, to the normal forwarding pulse generation unit 109A, and performs the normal forwarding driving on the second hand 124 by using the generated normal forwarding pulse in a low voltage operation mode. After the control circuit 103A completes the normal forwarding process in the low voltage operation mode, the process returns to Step S101.

Modification Example of Second Embodiment

Next, a modification example according to the present embodiment will be described.

Figure 14:
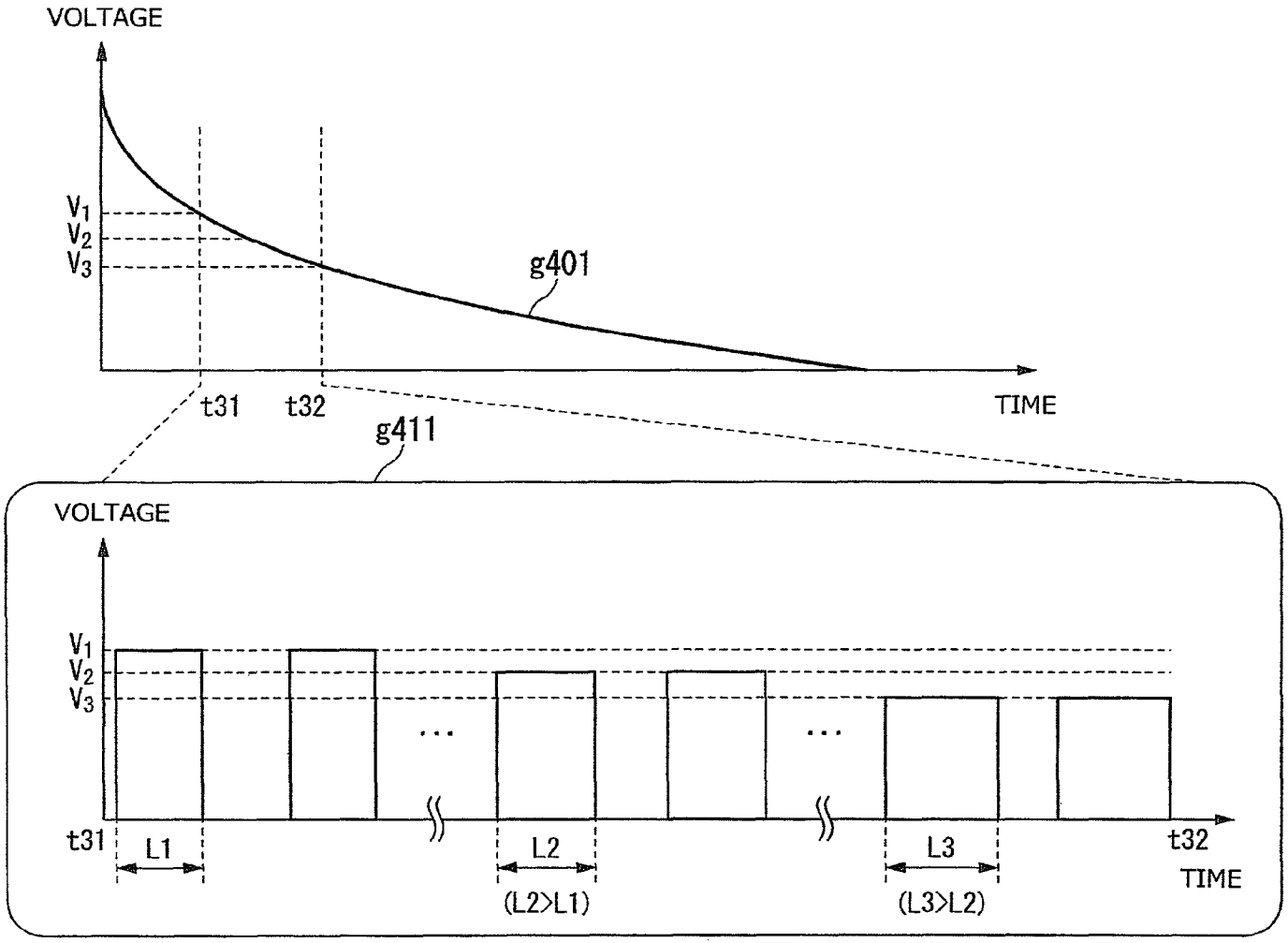
FIG. 14 is a graph illustrating an example of voltage drop in a secondary battery while fast-forwarding is driven, and an example of a fast-forwarding pulse according to a modification example of the second embodiment.

FIG. 14 is a graph illustrating an example of voltage drop in the secondary battery 105 while the fast-forwarding is driven, and an example of the fast-forwarding pulse according to the modification example of the present embodiment.

If the fast-forwarding is performed when the time is adjusted, as illustrated by a curve g401 in FIG. 14, the voltage of the secondary battery 105 together with the time drops during the fast-forwarding driving.

Therefore, the control circuit 103A acquires the voltage value shown during the fast-forwarding driving from the power source voltage detection circuit 106. Then, the control circuit 103A outputs an instruction to change pulse widths (L1, L2, and L3) in accordance with the acquired voltage value as illustrated in a region surrounded by the reference numeral g411 in FIG. 14, to the fast-forwarding pulse generation unit 108A.

The fast-forwarding pulse generation unit 108A changes the pulse widths together with the time in accordance with the instruction to change the pulse widths which is output from the control circuit 103A.

An example in which the fast-forwarding is performed using a frequency $f_H$ Hz will be described with reference to FIG. 13.

When the voltage value of the secondary battery 105 is $V_1$, it is assumed that a duty ratio is 50%.

When the voltage value of the secondary battery 105 is $V_1$, the fast-forwarding pulse generation unit 108A generates a fast-forwarding pulse signal whose pulse width is L1 $\{=(1/f_H)/2\}$.

When the voltage value of the secondary battery 105 drops from $V_1$ to $V_2$ ($V_2$ is smaller than $V_1$), the fast-forwarding pulse generation unit 108A generates a fast-forwarding pulse signal whose pulse width is L2 $\{=(V_1\times(1/f_H)/2)/V_2\}$. The pulse width L2 when the voltage value is $V_2$ is longer than the pulse width L1 when the voltage value is $V_1$ by an amount of $V_1/V_2$.

Furthermore, when the voltage value of the secondary battery 105 drops from $V_2$ to $V_3$ ($V_3$ is smaller than $V_2$), the fast-forwarding pulse generation unit 108A generates a fast-forwarding pulse signal whose pulse width is L3 $\{=(V_1\times(1/f_H)/2)/V_3\}$. The pulse width L3 when the voltage value is $V_3$ is longer than the pulse width L1 when the voltage value is $V_1$ by an amount of $V_1/V_3$.

That is, according to the modification example, the control circuit 103A controls the fast-forwarding pulse width to be widened in accordance with the voltage drop of the secondary battery 105 during the fast-forwarding driving. In this manner, even when the voltage drops, the fast-forwarding driving can be performed and the time can be adjusted by using the equivalent energy used when the fast-forwarding driving starts.

In general, when the time is adjusted by performing the fast-forwarding operation, the work is completed within several seconds to several ten seconds, that is, within one minute at the longest. Therefore, even when the voltage drops, if the fast-forwarding operation is performed in one minute, for example, the time can be adjusted.

In the modification example, even when the voltage of the secondary battery 105 drops down to the second threshold value $V_{ref2}$ or smaller, the fast-forwarding driving may be performed in one minute by changing the fast-forwarding pulse width in accordance with the voltage value of the secondary battery 105.

In the above-described example, an example has been described in which the control circuit 103A calculates the fast-forwarding pulse width by using the voltage value of the secondary battery 105 which is detected by the power source voltage detection circuit 106. However, the embodiment is not limited thereto. As illustrated in FIG. 14, the voltage value of the secondary battery 105 and the fast-forwarding pulse width may be associated with each other, and may be stored in the storage unit 115. In this case, the control circuit 103A may read the fast-forwarding pulse width corresponding to the acquired voltage value from the storage unit 115, and may output information indicating the read fast-forwarding pulse width, to the fast-forwarding pulse generation unit 108A.

A relationship between the voltage value of the secondary battery 105 and the time during the fast-forwarding driving may be obtained in advance. As illustrated in FIG. 14, the voltage value of the secondary battery 105, the time, and the fast-forwarding pulse width may be associated with each other, and may be stored in the storage unit 115. In this case, the control circuit 103A may acquire the voltage value of the secondary battery 105 when the fast-forwarding driving starts, and may read the pulse width corresponding to the acquired voltage value and the time from when the fast-forwarding driving starts, from the storage unit 115.

FIG. 15 is a table illustrating an example of information which is stored in the storage unit 115 according to a modification example of the present embodiment. In the example illustrated in FIG. 15, the duty ratio is 50% when the fast-forwarding frequency is 128 Hz and the voltage value of the secondary battery 105 is 2.3 V. According to the example illustrated in FIG. 15, the time, the voltage value of the secondary battery 105, and the fast-forwarding pulse width are associated with each other, and are stored in the storage unit 115.

For example, when the voltage value is 2.3 V, the fast-forwarding pulse width is approximately 3.90 msec. When the voltage value is 2.25 V, the fast-forwarding pulse width is approximately 3.99 msec $\{=(2.3\times(1/128)/2)/2.25\}$.

The time represents a time measured from when the fast-forwarding driving starts. For example, if the fast-forwarding driving starts from 2.3 V, the control circuit 103A regards time t0 as a start time, and regards that the voltage value drops down to 2.25 V after time (t1-t0) elapses. In this manner, the control circuit 103A reads the fast-forwarding pulse width 3.99 msec.

In the present embodiment, an example has been described in which the duty ratio is 50%. However, the duty ratio may be changed within a range which ensures a stable operation.

As described above, the electronic timepiece 1A according to the present embodiment includes the solar power source 151 (the solar panel 104 and the secondary battery 105), the voltage stabilizer circuit 107A that generates the constant voltage $V_C$ by using the power supplied from the solar power source, and the control circuit 103A that clocks the time by driving the rotating body (the hour hand 122, the minute hand 123, and the second hand 124) at the first hand operation speed (normal forwarding speed) and at the second hand operation speed (fast-forwarding speed) which is faster than the first hand operation speed. In a case of the first hand operation speed, the control circuit 103A drives the rotating body by using the voltage $V_B$ of the solar power source 151. In a case of the second hand operation speed, the control circuit 103A drives the rotating body by selecting at least any one voltage of the constant voltage $V_C$ and the voltage $V_B$ of the solar power source 151.

According to the present embodiment, similarly to the first embodiment, this configuration can further reduce current consumption of the motor 111 when the normal forwarding operation is performed, compared to the electronic time piece in the related art which performs the driving by using the constant voltage. According to the electronic timepiece 1A of the present embodiment, similarly to the first embodiment, this configuration can further lengthen the driving time of the secondary battery 105, compared to the electronic timepiece in the related art. Furthermore, according to the electronic timepiece 1A of the present embodiment, similarly to the first embodiment, the normal forwarding operation is performed even during the charging. Accordingly, it is possible to shorten the time required for charging the secondary battery by reducing the current consumption of the motor 111 when the normal forwarding operation is performed.

In the electronic timepiece 1A according to the present embodiment, the rotating body includes the hour hand 122, the minute hand 123, and the second hand 124. The electronic timepiece 1A includes the multiple motors (1111, 1112, and 1113) which respectively drive the hour hand, the minute hand, and the second hand. In a case of the first hand operation speed (normal forwarding speed), the control circuit 103A drives at least the second hand within the rotating body by using the voltage $V_B$ of the solar power source 151 (the solar panel 104 and the secondary battery 105).

According to the present embodiment, this configuration is adopted so as to drive the second hand 124 which is most frequently driven within the indicating hand 125, by using the battery voltage when the normal forwarding operation for displaying the time is performed. In this manner, the current consumption of the motor 1111 can be further reduced, compared to the electronic timepiece in the related art which drives the second hand 124 by using the constant voltage. According to the electronic timepiece 1A in the present embodiment, this configuration can further lengthen the driving time of the secondary battery 105, compared to the electronic timepiece in the related art.

According to the electronic timepiece 1A in the present embodiment, the control circuit 103A has the two threshold values of the first threshold value $V_{ref1}$ and the second threshold value $V_{ref2}$ which is smaller than the first threshold value $V_{ref1}$ in order to determine the voltage value of the solar power source 151 (the solar panel 104 and the secondary battery 105). The control circuit 103A compares the voltage value of the solar power source with the two threshold values, and switches the voltage used in a case of the second hand operation speed (fast-forwarding speed) in accordance with the comparison result.

According to the present embodiment, this configuration is adopted so that the voltage used in the fast-forwarding operation is switched by using the first threshold value $V_{ref1}$ and the second threshold value $V_{ref2}$. In this manner, power of the secondary battery 105 can be effectively utilized, and the fast-forwarding driving can be stably performed.

The electronic timepiece 1A according to the present embodiment includes the detection unit (power source voltage detection circuit 106) which detects the voltage value of the solar power source 151 (the solar panel 104 and the secondary battery 105). When the detected voltage value of the solar power source is greater than the first threshold value $V_{ref1}$, the control circuit 103A drives the rotating body at the first hand operation speed (normal forwarding speed) by using the voltage $V_B$ of the solar power source, and drives the rotating body at the second hand operation speed (fast-forwarding speed) by using the constant voltage $V_C$. When the detected voltage value of the solar power source is equal to or less than the first threshold value and equal to or greater than the second threshold value $V_{ref2}$, the control circuit 103A drives the rotating body at the first hand operation speed and at the second hand operation speed by using the voltage $V_B$ of the solar power source. When the detected voltage value of the solar power source is smaller than the second threshold value, the control circuit 103A drives the rotating body at the first hand operation speed by using the voltage whose voltage value is smaller than the voltage value of the solar power source, and switches the voltage so as to stop driving the rotating body at the second hand operation speed.

According to the present embodiment, this configuration is adopted so that the voltage used in the fast-forwarding operation is switched in accordance with the voltage value of the secondary battery 105 which accumulates power generated by using sunlight. In this manner, power of the secondary battery 105 can be effectively utilized, and the fast-forwarding driving can be stably performed.

The electronic timepiece 1A according to the present embodiment includes the input unit 113A which receives instructions. The detection unit (power source voltage detection circuit 106) detects the voltage value of the solar power source, when the instruction received by the input unit 113A is given in order to perform the driving at the second hand operation speed (fast-forwarding speed).

According to the present embodiment, this configuration is adopted so that the input unit 113A receives the fast-forwarding instruction in accordance with the result in which the input unit 113A is operated by a user. Alternatively, the input unit 113A receives the fast-forwarding instruction from the terminal 3. Then, the electronic timepiece 1A acquires the voltage value of the secondary battery 105 in accordance with the received fast-forwarding instruction, when the fast-forwarding operation is performed. In this manner, according to the present embodiment, the electronic timepiece 1A detects the voltage value of the secondary battery 105, only when the fast-forwarding instruction is received. Therefore, it is possible to reduce power consumption required for detecting the voltage value of the secondary battery 105.

In the electronic timepiece 1A according to the present embodiment, when the driving the rotating body is performed at the second hand operation speed (fast-forwarding speed), the drive pulse width is widened as the rotating body is progressively driven at the second hand operation speed.

According to the present embodiment, this configuration is adopted so that the pulse width is controlled during the fast-forwarding driving so as to be widened in accordance with the decreased voltage value. As a result, according to the present embodiment, even when the voltage value of the secondary battery 105 further decreases during the fast-forwarding driving than the voltage value when the fast-forwarding driving starts, the fast-forwarding driving can be stably performed.

In the electronic timepiece 1A according to the present embodiment, the rotating body (the hour hand 122, the minute hand 123, and the second hand 124) which is driven at the second hand operation speed (fast-forwarding speed) performs the forward rotation operation and the reverse rotation operation. The control circuit 103A performs at least any one of selecting and changing each value of the first threshold value $V_{ref1}$ and the second threshold value $V_{ref2}$ in accordance with the forward rotation operation or the reverse rotation operation.

According to the present embodiment, this configuration is adopted so that the control circuit 103A performs at least any one of selecting and changing each value of the first threshold value and the second threshold value in accordance with the forward rotation operation or the reverse rotation operation, when the voltage value required for the motor 111 which drives the indicating hand 125 varies during the forward rotation and during the reverse rotation. As a result, according to the present embodiment, the fast-forwarding driving can be stably performed not only during forward rotation operation but also during the reverse rotation operation.

In the first embodiment and the second embodiment, an example has been described in which the electronic timepiece 1 or 1A includes the solar panel 104 (solar cell) and the secondary battery 105 as the solar power source. However, a primary battery (not illustrated) may be provided therein. In this case, for example, the control circuit 103 or the control circuit 103A may supply power supplied from the primary battery to the voltage stabilizer circuit 107 or 107A, when the voltage value of the secondary battery 105 is equal to or smaller than 2.3 V of the constant voltage. The primary battery includes a coin type (or a button type) of lithium battery, a silver oxide battery, and the like.

The secondary battery may be an accumulator battery or an electrolytic capacitor having capacity higher than a predetermined standard.

Each voltage value described in the first embodiment and the second embodiment is an example, and is not limited thereto. For example, the maximum voltage value of the secondary battery 105 may be equal to or greater than the constant voltage. For example, the maximum voltage value of the secondary battery 105 may be smaller than approximately 3.0 V. Without being limited to 2.3 V, the voltage value of the constant voltage may also be equal to or greater than the voltage of the secondary battery 105 in the second region described with reference to FIG. 4.

In the first embodiment and the second embodiment, an example has been described in which the electronic timepiece includes the auxiliary drive pulse generation unit 110, but the embodiment is not limited thereto. For example, the control circuit 103 or 103A may control the frequency divider circuit 102 so as to correct a division ratio thereof, when the control circuit 103 or 103A determines that it is necessary to correct the normal forwarding pulse signal based on information input from the rotation detection/determination circuit 112. For example, if a correction period for correcting is "10" seconds, a correction unit time (=(oscillation clock frequency)$^{-1}$) is "1/32768" seconds, an adjustment amount is "1", and an adjustment direction is a direction in which "the timepiece is set forward", the control circuit 103 or 103A may control the frequency divider circuit 102 so as to narrow a pulse width of one clock signal every ten seconds by the amount of "1"×"1/32768" seconds.

The electronic timepiece 1 or 1A described in the first embodiment and the second embodiment may be a wristwatch, a wall clock, a table clock, or an electronic timepiece for an analog display.

Functions of each unit included in the electronic timepiece 1 or 1A according to the above-described embodiments may be entirely or partially realized in such a way that a program for realizing the functions is executed after the program is recorded on a computer-readable recording medium and the program recorded on the recording medium is read by a computer system. The "computer system" described herein includes an OS and hardware such as peripheral devices.

The "computer-readable recording medium" represents a portable medium such as a flexible disk, an optical magnetic disk, a ROM, and a CD-ROM, and a storage unit such as a hard disk incorporated in the computer system. Furthermore, the "computer-readable recording medium" may include those which dynamically maintain the program in a short period of time, like a communication line when the program is transmitted via a network such as Internet or a communication line such as a telephone line, or those which maintain the program for a certain period of time, like a volatile memory installed inside the computer system functioning as a server or a client in that case. The above-described program may partially realize the above-described functions. Furthermore, the above-described functions may be realized in combination with a program which is previously recorded in the computer system.

What is claimed is:

1. An electronic timepiece comprising:

a solar power source;

a voltage stabilizer circuit that generates a constant voltage by using power supplied from the solar power source; and a control circuit that clocks the time by driving a rotating body at first hand operation speed and at second hand operation speed which is faster than the first hand operation speed, wherein the control circuit selects a voltage of the solar power source so as to drive the rotating body in a case of the first hand operation speed, and selects at least any one voltage of the constant voltage and the voltage of the solar power source so as to drive the rotating body in a case of the second hand operation speed.

2. The electronic timepiece according to claim 1, wherein the rotating body includes an hour hand, a minute hand, and a second hand, wherein the electronic timepiece includes multiple motors which respectively drive the hour hand, the minute hand, and the second hand, and wherein in a case of the first hand operation speed, the control circuit drives at least the second hand within the rotating body by using the voltage of the solar power source.

3. The electronic timepiece according to claim 1, wherein the control circuit has two threshold values of a first threshold value for determining a voltage value of the solar power source and a second threshold value which is smaller than the first threshold value, and wherein the control circuit compares the voltage value of the solar power source with the two threshold values, and switches a voltage used in the case of the second hand operation speed in accordance with a comparison result.

4. The electronic timepiece according to claim 3, further comprising:

a detection unit that detects the voltage value of the solar power source, wherein when the detected voltage value of the solar power source is greater than the first threshold value, the control circuit drives the rotating body at the first hand operation speed by using the voltage of the solar power source, and drives the rotating body at the secondhand operation speed by using the constant voltage, wherein when the detected voltage value of the solar power source is equal to or smaller than the first threshold value and equal to or greater than the second threshold value, the control circuit drives the rotating body at the firsthand operation speed and at the second hand operation speed by using the voltage of the solar power source, and wherein when the detected voltage value of the solar power source is smaller than the second threshold value, the control circuit drives the rotating body at the first hand operation speed by using a voltage whose voltage value is smaller than the voltage value of the solar power source, and switches the voltage so as to stop driving the rotating body at the second hand operation speed.

5. The electronic timepiece according to claim 4, further comprising:

an input unit that receives an instruction, wherein the detection unit detects the voltage value of the solar power source, when the instruction received by the input unit is given so as to drive the rotating body at the second hand operation speed.

6. The electronic timepiece according to claim 1, wherein when the rotating body is driven at the second hand operation speed, a drive pulse width is widened as the rotating body is progressively driven at the second hand operation speed.

7. The electronic timepiece according to claim 3, wherein when the rotating body is driven at the second hand operation speed, a drive pulse width is widened as the rotating body is progressively driven at the second hand operation speed.

8. The electronic timepiece according to claim 3, wherein the rotating body which is driven at the second hand operation speed performs a forward rotation operation and a reverse rotation operation, and wherein the control circuit performs at least any one between selecting and changing each value of the first threshold value and the second threshold value in accordance with the forward rotation operation or the reverse rotation operation.

9. The electronic timepiece according to claim 4, wherein the rotating body which is driven at the second hand operation speed performs a forward rotation operation and a reverse rotation operation, and wherein the control circuit performs at least any one between selecting and changing each value of the first threshold value and the second threshold value in accordance with the forward rotation operation or the reverse rotation operation.

10. A control method of an electronic timepiece that has two threshold values of a first threshold value for determining a voltage value of a solar power source and a second threshold value which is smaller than the first threshold value, and that clocks the time by driving a rotating body at first hand operation speed and at second hand operation speed which is faster than the first hand operation speed, the method comprising:

a voltage stabilizing procedure in which a voltage stabilizer circuit generates a constant voltage by using power supplied from the solar power source;

a procedure in which a control circuit drives the rotating body by using a voltage of the solar power source in a case of the first hand operation speed;

a procedure in which when the voltage value of the solar power source is greater than the first threshold value, the control circuit drives the rotating body at the first hand operation speed by using the voltage of the solar power source, and drives the rotating body at the second hand operation speed by using the constant voltage;

a procedure in which when the voltage value of the solar power source is equal to or smaller than the first threshold value and equal to or greater than the second threshold value, the control circuit drives the rotating body at the first hand operation speed and at the second hand operation speed by using the voltage of the solar power source; and a procedure in which when the voltage value of the solar power source is smaller than the second threshold value, the control circuit drives the rotating body at the first hand operation speed by using a voltage whose voltage value is smaller than the voltage value of the solar power source, and switches the voltage so as to stop driving the rotating body at the second hand operation speed.

* * * * *